US005847736A

United States Patent [19]

Kanbayashi et al.

[11] Patent Number: 5,847,736

[45] Date of Patent: Dec. 8, 1998

[54] INK JET RECORDER AND RECORDING HEAD CLEANING METHOD

[75] Inventors: Kenichi Kanbayashi; Hiroe Niimura; Toshio Kumagai; Toru Fukushima, all of Nagano, Japan

[73] Assignee: Seiko Epson Corporation, Tokyo, Japan

[21] Appl. No.: 578,609

[22] PCT Filed: May 16, 1995

[86] PCT No.: PCT/JP95/00927

§ 371 Date: Jan. 17, 1996

§ 102(e) Date: Jan. 17, 1996

[87] PCT Pub. No.: WO95/31335

PCT Pub. Date: Nov. 23, 1995

[30] Foreign Application Priority Data

| | | | |
|---|---|---|---|
| May 17, 1994 | [JP] | Japan | 6-103034 |
| May 23, 1994 | [JP] | Japan | 6-108693 |
| Sep. 12, 1994 | [JP] | Japan | 6-217450 |
| Oct. 14, 1994 | [JP] | Japan | 6-249862 |
| Mar. 31, 1995 | [JP] | Japan | 7-99734 |
| Apr. 6, 1995 | [JP] | Japan | 7-081417 |
| Apr. 20, 1995 | [JP] | Japan | 7-095713 |

[51] Int. Cl.[6] ..... B41J 2/18

[52] U.S. Cl. ..... 347/89; 347/33

[58] Field of Search ..... 347/85, 23, 33, 347/89

[56] References Cited

U.S. PATENT DOCUMENTS

| | | | |
|---|---|---|---|
| 4,278,984 | 7/1981 | Matsumoto et al. | 347/85 |
| 4,500,894 | 2/1985 | Kirner | 346/140 R |
| 4,558,326 | 12/1985 | Kimura et al. | 346/1.1 |
| 5,097,275 | 3/1992 | Takita | 347/56 |
| 5,382,969 | 1/1995 | Mochizuki et al. | 347/23 |

FOREIGN PATENT DOCUMENTS

| | | | |
|---|---|---|---|
| A2 0 465 260 | 1/1992 | European Pat. Off. | B41J 2/165 |
| A2 0 585 923 | 3/1994 | European Pat. Off. | B41J 2/165 |
| 51-77036 | 7/1976 | Japan . | |
| 52-150035 | 12/1977 | Japan | B41J 3/00 |
| 56-2023 | 1/1981 | Japan | B41J 3/04 |
| 57-34969 | 2/1982 | Japan | B41J 3/04 |
| 59-14962 | 1/1984 | Japan | B41J 3/04 |
| 60-13556 | 1/1985 | Japan | B41J 3/04 |
| 62-161544 | 7/1987 | Japan | B41J 3/04 |
| 2-523 | 1/1990 | Japan | B41J 2/175 |
| 3-182363 | 8/1991 | Japan | B41J 2/18 |
| 3-227658 | 10/1991 | Japan | B41J 2/18 |
| 4-28559 | 1/1992 | Japan . | |
| 4-3308 | 1/1992 | Japan | B41J 2/165 |
| 4-43785 | 7/1992 | Japan | B41J 2/175 |
| WO 87/04979 | 8/1987 | WIPO | B41J 3/04 |

OTHER PUBLICATIONS

Patent Abstracts of Japan vol. 011, No. 330 (M—636), 28 Oct. 1987 & JP–A–62 111751 (Canon Inc), 22 May 1987, *Abstract* Only.

*Primary Examiner*—Shawn Riley

*Attorney, Agent, or Firm*—Sughrue, Mion, Zinn, Macpeak & Seas, PLLC

[57] ABSTRACT

With an ink jet recording head (8) comprising two common ink chambers (26) and (27) communicating with both sides of a pressure generation chamber (24) and ink supply ports (30) and (31) where ink flows into the common ink chambers (26) and (27) from the outside, one ink supply port (30) is connected to a subtank (10) and the other ink supply port (31) is connected to an ink cartridge (6). The subtank (10) is replenished with ink through the ink jet recording head (8). Since ink reversely flows into the ink cartridge (6) via the recording head (8) from the subtank (10) due to the head difference, ink in the recording head (8) can be forcibly circulated without complicating a flow passage configuration.

34 Claims, 16 Drawing Sheets

INK JET RECORDER AND RECORDING HEAD CLEANING METHOD

BACKGROUND OF THE INVENTION

1. Field of the Invention

This invention relates to an ink jet recorder having an ink jet recording head mounted on a carriage and an ink cartridge placed in a box for supplying ink to the recording head via a tube from an ink tank, and a recording head cleaning method.

2. Description of the Related Art

An ink jet recorder has an ink jet recording head mounted on a carriage for spouting ink drops by pressure generation means for printing while receiving an ink supply from an ink tank. Usually, an ink cartridge is also mounted on the carriage provided with the recording head for simplifying the structure.

As performance of ink jet recording heads improves, the dot density increases significantly, thus enabling color printing in natural color. To further improve the print quality, an effort is under way to reduce blurs on recording media as much as possible.

As one means, a method is proposed, wherein an emulsion or saccharides are contained in an ink and recording media are filmed with ink drops.

With ink having such a filming property, there is a concern that a porous substance required for an on-carriage type cartridge may interfere with the ink flow into a recording head. Thus, a separate ink supply method is proposed, wherein while a subtank is mounted on a carriage, ink is drawn from an ink cartridge placed in a box and is supplied via the subtank to a recording head.

For example, as disclosed in Japanese Patent Publication No.Hei 4-43785, a recording head and a subtank are mounted on a carriage, with the subtank, with a main tank by a tube. After new ink is drawn into the subtank, ink is supplied from the subtank to the recording head.

According to the method, in addition to smooth supply of ink to the recording head because of the absence of a porous substance, the entire carriage can be lightened for high-speed printing, and the ink replenishment period can be prolonged. However, as the carriage reciprocates, bubbles occurring in the subtank enter the recording head, hindering ink spouting.

To solve such a problem, a method wherein a recording head, a subtank, and an ink cartridge are connected as an endless loop for circulating ink is also proposed. However, since this method requires two flow passages of going and returning, the flow passage structure is complicated. Also, ink needs to be fed by a pump, and comes in contact with movable members, causing the ink and the pump to degrade.

SUMMARY OF THE INVENTION

It is therefore an object of the invention to provide an ink jet recorder comprising an ink supply system which can exclude bubbles in a recording head and further prevent ink in the recording head from forming a film or increasing viscosity without complicating the structure.

It is another object of the invention to provide components appropriate for such an ink supply system.

It is a further object of the invention to provide a maintenance method by which the ink drop spout capability of the recording head can be recovered by actively using the components.

To these ends, according to the invention, there is provided an ink jet recorder wherein an ink jet recording head and a subtank are mounted on a carriage, ink is supplied by ink supply means from an ink cartridge placed outside the carriage to the subtank, and during printing, ink is supplied from the subtank to the recording head, characterized in that the ink jet recording head comprises two common ink chambers communicating with both sides of pressure generation chambers, and ink supply ports where ink flows into the common ink chambers from the outside, one ink supply port being connected to the subtank and the other being connected to the ink cartridge, wherein the subtank is replenished with ink through the ink jet recording head by the ink supply means.

Thus, the ink from the ink cartridge passes through the recording head before flowing into the subtank, so that bubbles remaining in the recording head and a high concentration of ink near nozzle openings are forcibly discharged and are mixed with new ink in the subtank to a proper concentration, then the resultant ink is supplied to the recording head.

BRIEF DESCRIPTION OF THE DRAWINGS

In the accompanying drawings:

FIG. 2 is a horizontal sectional view of the head at the center of an ink supply port and FIG. 3 is a front view of the head when a nozzle plate is removed;

BEST MODE FOR CARRYING OUT THE INVENTION

Referring now to the accompanying drawings, there are shown embodiments of the invention.

Figure 1:
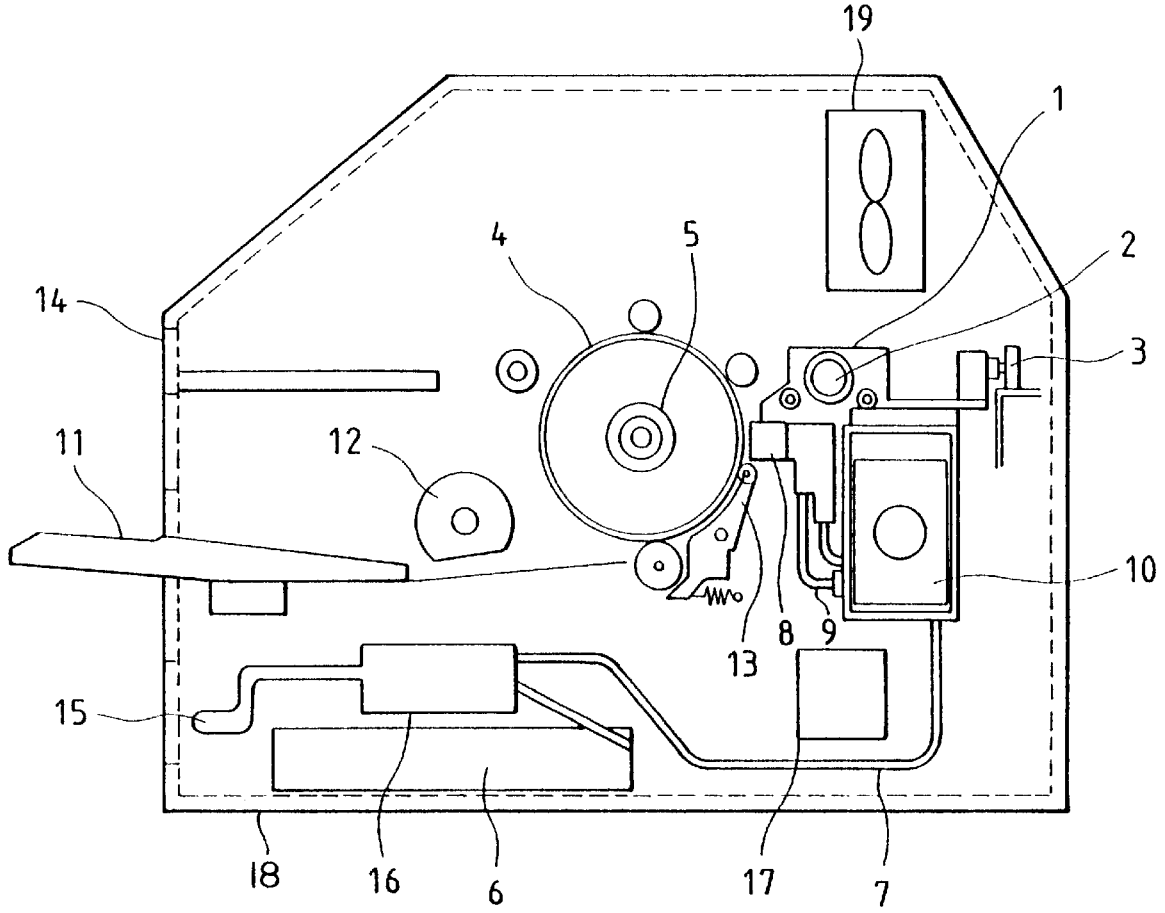
FIG. 1 is a schematic diagram showing one embodiment of a printer to which an ink supply system of the invention is applied.

FIG. 1 shows one embodiment of an ink jet printer to which an ink supply system of the invention is applied. In the figure, numeral 1 is a carriage being supported by guide members 2 and 3 for moving in parallel with a rotation shaft 5 of a platen 4 described below. Mounted on the carriage 1 are a recording head 8 directly connected to an ink cartridge 6 (described below) by a tube 7 and a subtank 10 being connected to the recording head 8 by a tube 9 for temporarily storing ink. Disposed in a nonprint area are capping means capable of abutting the recording head 8 and a waste ink tank 17 for storing ink discharged from the recording head 8.

Numeral 4 is the above-mentioned platen for holding a sheet of recording paper taken by a pick-up roller 12 from a paper feed tray 11 on the surface by a claw member 13 and receiving ink drops from the recording head 8 on the sheet of recording paper for forming dots and discharging it into a paper discharge port 14 while ink is being dried by a heater.

Numeral 6 is the above-mentioned ink cartridge into which an ink supply needle is inserted by a lever 15 that can be handled from the outside of a box 18 for supplying ink to the recording head 8 via the ink tube 7 connected to the needle. Numeral 19 is an exhaust fan.

Figure 2:
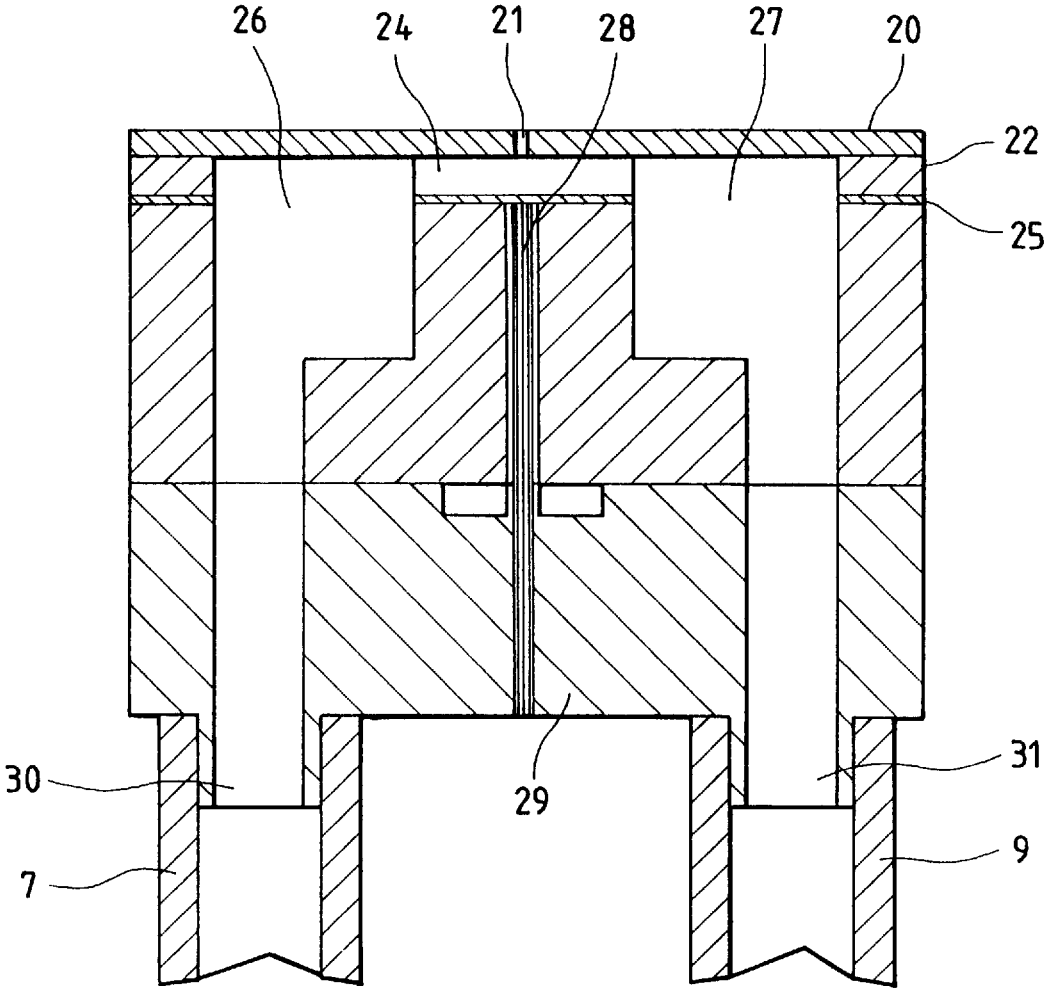
FIGS. 2 and 3 show each one embodiment of an ink jet recording head used with the system.
Figure 3:
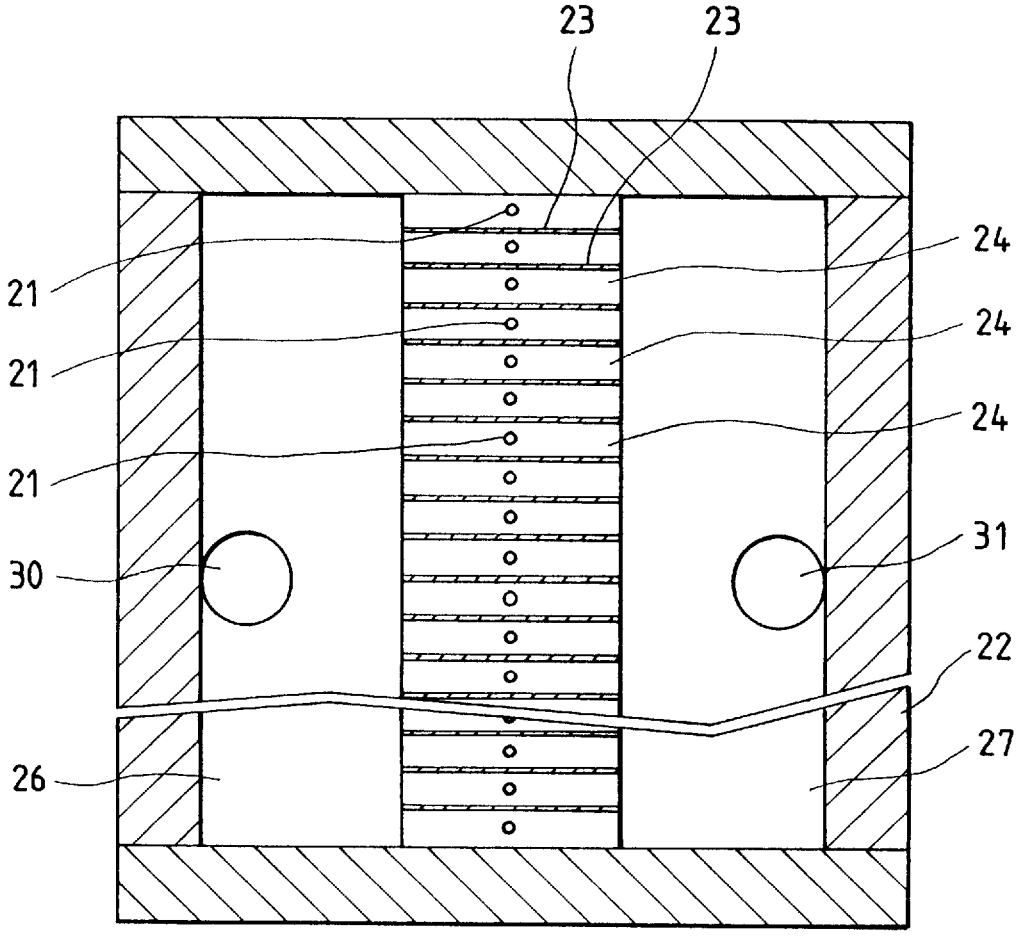

FIGS. 2 and 3 show each one embodiment of the ink jet recording head 8, wherein numeral 20 is a nozzle plate with nozzle openings 21 placed in a linear or staggered arrangement for sealing a spacer 22 described below. Numeral 22 is the spacer formed with through holes so as to partition pressure generation chambers 24, 24, 24 . . . by forming bulkheads 23, 23, 23 at equal intervals so as to separate adjacent nozzle openings 21, 21, 21. The spacer 22 has one face sealed by the nozzle plate 20 and the other sealed by a vibration plate 25. Common ink chambers 26 and 27 are disposed on both sides of the pressure generation chambers 24, 24, 24 . . . ; ink is moved via the pressure generation chambers 24 from one common ink chamber 26 to the other common ink chamber 27. Numeral 28 is a piezoelectric vibrator comprising an electrode and piezoelectric vibration material laminated like a sandwich so as to generate vibration in a longitudinal vibration mode. The tips of as many piezoelectric vibrators as the nozzles 21, 21, 21 are abutted against the vibration plate 25 and the opposite end is fixed to a base 29. The piezoelectric vibrations are lengthened according to a print signal for spouting ink drops through nozzle openings 21.

Numerals 30 and 31 are a first ink supply port and a second ink supply port, respectively, communicating with the common ink chambers 26 and 27, respectively. The first and second ink supply ports are connected to the ink cartridge 6 and the subtank 10 via the tubes 7 and 9, respectively.

Figure 4:
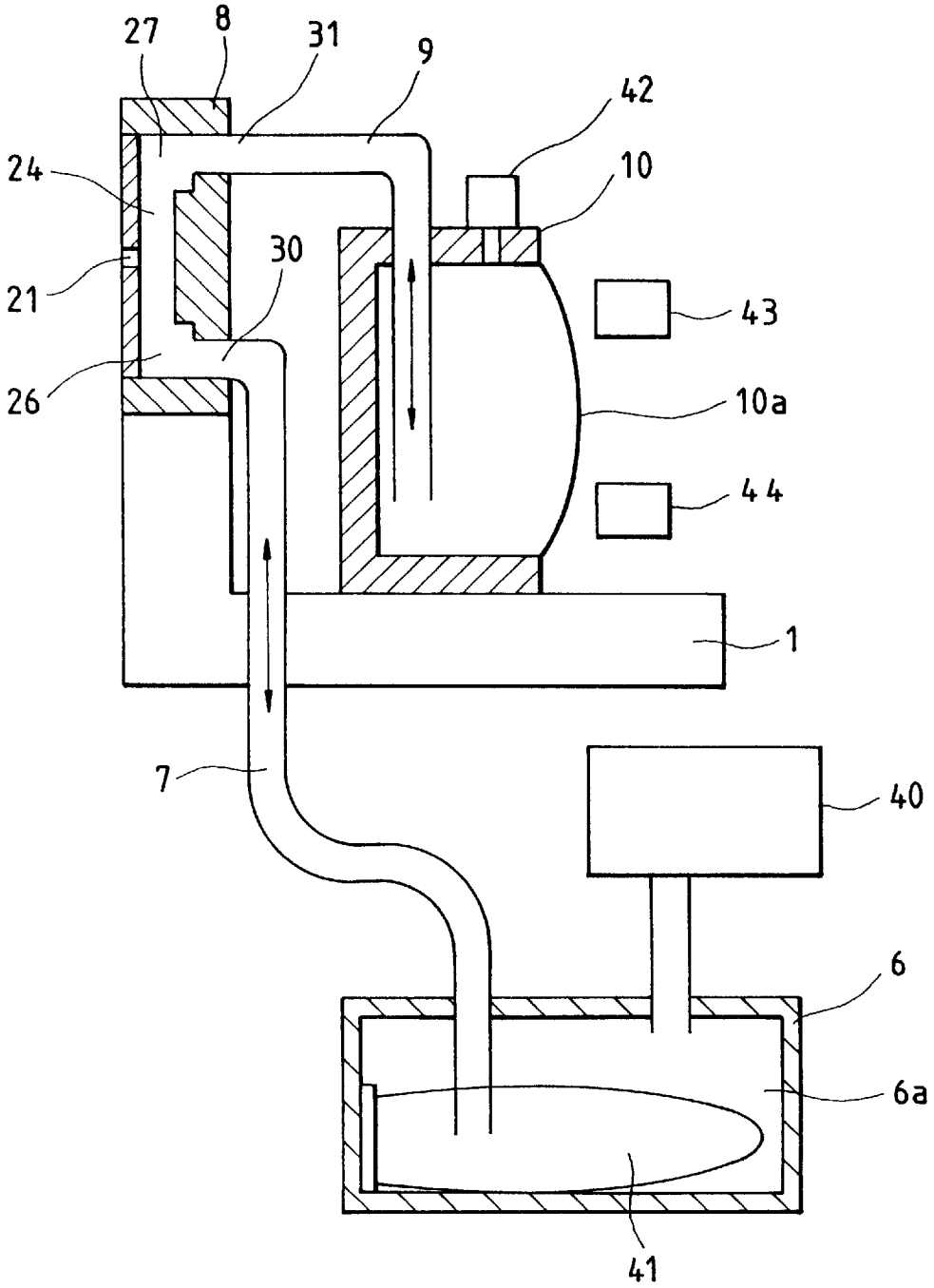
FIG. 4 is a schematic diagram showing an overview of the ink supply system of the invention.

FIG. 4 is an overview of the ink supply system in the ink jet printer of the invention. The first ink supply port 30 of the recording head 8 mounted on the carriage 1 is connected to an ink bag 41 housed in the cartridge 6 by the tube 7. Likewise, the subtank 10 mounted on the carriage 1 is connected to the second ink supply port 31 of the recording head 8 by the tube 9. If the ink bag 41 is pressurized by supplying pressure air to a space 6*a* of the cartridge 6 by liquid feed means (in the embodiment, an air pump 40 supplying air to the airtight space 6*a* of the cartridge 6) in a state in which the nozzle openings 21 are sealed by the capping means described below, the ink bag 41 in the cartridge is compressed, causing ink in the ink bag 41 to flow through the tube 7 into the first ink supply port 30 of the recording head 8. The ink flows from one common ink chamber 26 through the pressure generation chamber 24 into the other common ink chamber 27, then exits the second ink supply port 31 and flows into the subtank 10.

In this process, bubbles remaining in the common ink chambers 26 and 27 and the pressure generation chamber 24 and ink whose concentration increases near the nozzle openings 21 are discharged into the subtank 10, and the nozzle openings 21 and the pressure generation chambers 24 are washed with new ink. When replenishment of the subtank with ink proceeds and space pressure of the subtank 10 rises, only air is discharged into the atmosphere from an air vent valve 42. When the subtank 10 is filled with ink to the full ink level, a signal is output from an ink full sensor 43, stopping the air pump 40, the air vent valve 42 being automatically closed.

Then, the ink in the subtank 10 reversely flows via the tube 9 through the recording head 8 into the ink cartridge 6 due to the head difference based on the height difference between the carriage 1 and the cartridge 6. As the reverse flow into the ink cartridge 6 proceeds and the ink amount of the subtank 10 lessens, an ink empty sensor outputs a signal, thus the air pump 40 operates for again replenishing the subtank 10 with ink via the recording head 8 from the ink cartridge 6. When the subtank 10 fills with ink, air supply from the air pump 40 stops. As ink flows by replenishing the subtank 10 with ink, ink in the recording head 8 is once discharged into the subtank 10 and mixed with new ink with which the subtank 10 is replenished to a concentration appropriate for printing as much as possible, then the mixed ink again flows into the recording head 8.

Reciprocating circulation of ink between the subtank 10 and the ink cartridge 6 via the recording head 8 by replenishing the subtank 10 with ink each time ink in the subtank 10 reversely flows and decreases is repeated for washing the pressure generation chambers 24 of the recording head 8, the common ink chambers 26 and 27, and the nozzle openings 21 with new ink and maintaining the ink concentration to an optimum value for printing.

Next, components making up the ink supply system described above will be discussed.

Figure 5:
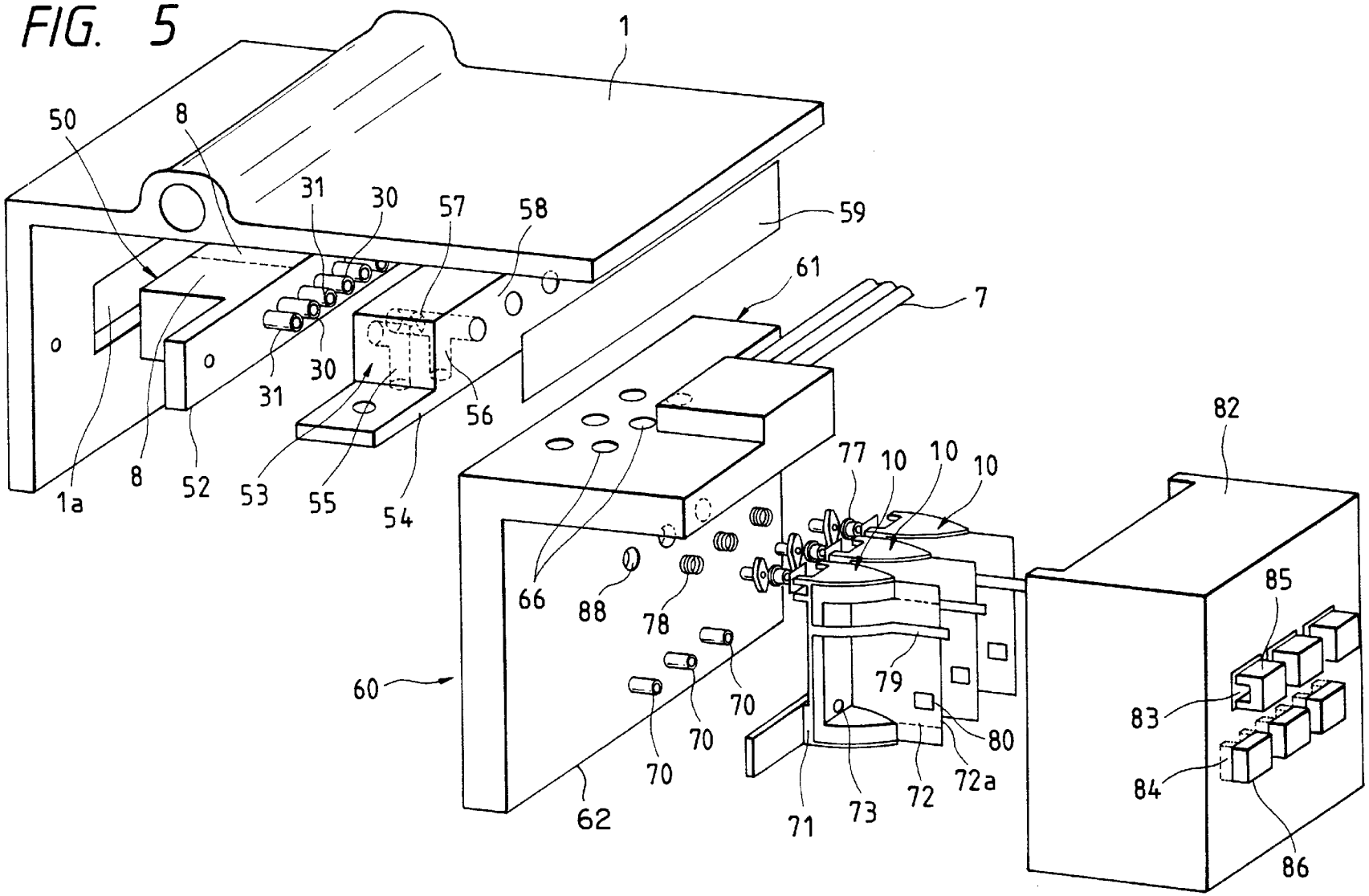
FIG. 5 is a perspective view of assembly showing one embodiment of a subtank built in a carriage.

FIG. 5 shows an embodiment of the subtank 10 and the recording head 8 integrated into a flow passage component. In the figure, numeral 50 is a recording head unit with recording heads 8, 8, 8, for spouting black, yellow, cyan, and magenta ink drops, fixed integrally with a base 52 for attachment to a window 1*a* of the carriage 1. The first and second ink supply ports 30 and 31 connected to the two common ink chambers of each recording head 8 are projected from the rear face of the base 52.

Numeral 53 is a filter member having an L-letter through hole 55 opened to a position facing the second ink supply ports 31 of the recording heads 8, 8, 8, a bottom face 54, and a T-letter through hole 56 extending from the face opposed to the first ink supply port 30 to an opposed face 58 and opened to the bottom face 54. A filter 57 is inserted into the through hole 56 and a face 58 is sealed with a flexible film 59.

Numeral 60 is a flow passage component consisting of a top face 61 joined to the bottom face 54 of the filter member 53 and a main unit 62 used as a fixed base board of the subtanks 10, 10, 10. The ink tube 7 from the ink cartridge 6 is attached to the top face 61.

Figure 6:
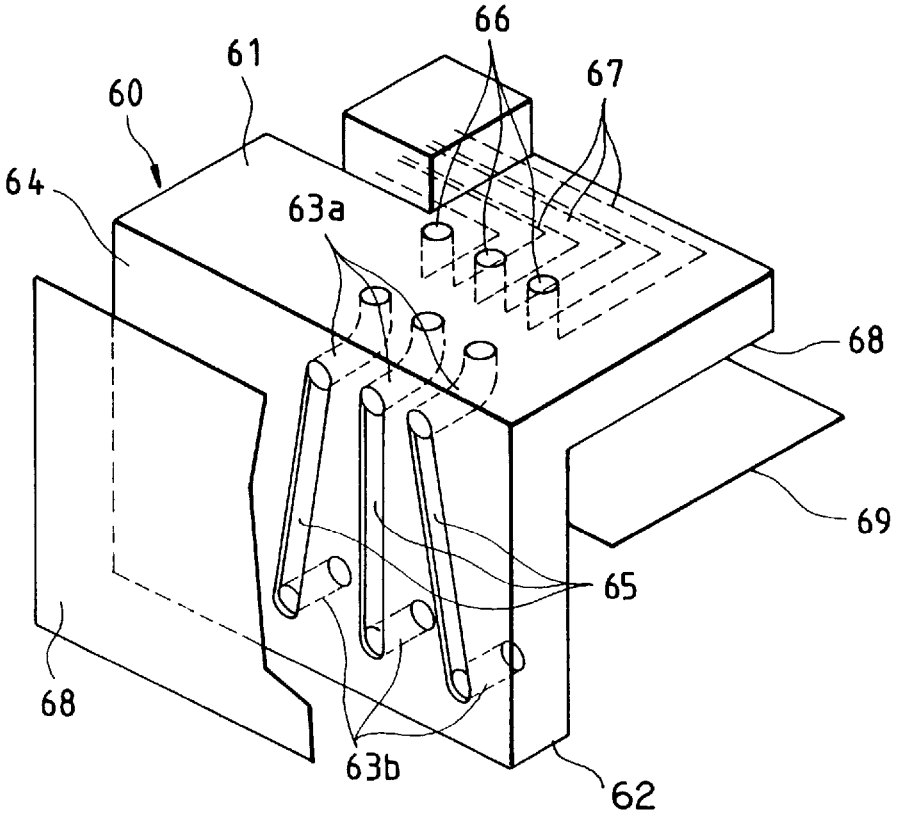
FIG. 6 is an illustration showing flow passages of a flow passage component.

As shown in FIG. 6, the flow passage component 60 has inflow ports 63*a* on the top face 61 joined to the bottom face 54 of the filter member 53 for communicating with the through hole 55, ports 63*b* communicating with the bottoms of the subtanks 10 described below, grooves 65 formed on a side face 64 and communicating with the ports 63*a* and 63*b* on both ends, through holes 66 each having one end connected to the T-letter through hole 56 of the filter member 53, and grooves 67 formed on the bottom face, each having one end connected to the tube 7. The grooves 65 on the side face 64 and the grooves 67 on the bottom face are sealed with flexible films 68 and 69.

A part of the flow passages is formed by the flexible films 68 and 69, whereby pressure change caused by ink fluctuation caused by movement of the carriage 1 during printing can be promptly absorbed by the flexible films 68 and 69 for maintaining the ink pressure of the recording head 8 as constant as possible.

Referring again to FIG. 5, numerals 10, 10, and 10 are the above-mentioned subtanks, each consisting of a frame 71 whose top and bottom are formed in a triangular shape and a non-permeable flexible film 72 joined to the top and bottom of the frame such that the cross section of the film 72 is a triangular shape. The film 72 extends beyond the frame 71 to form overlapping portions which are bonded together.

Figure 7:
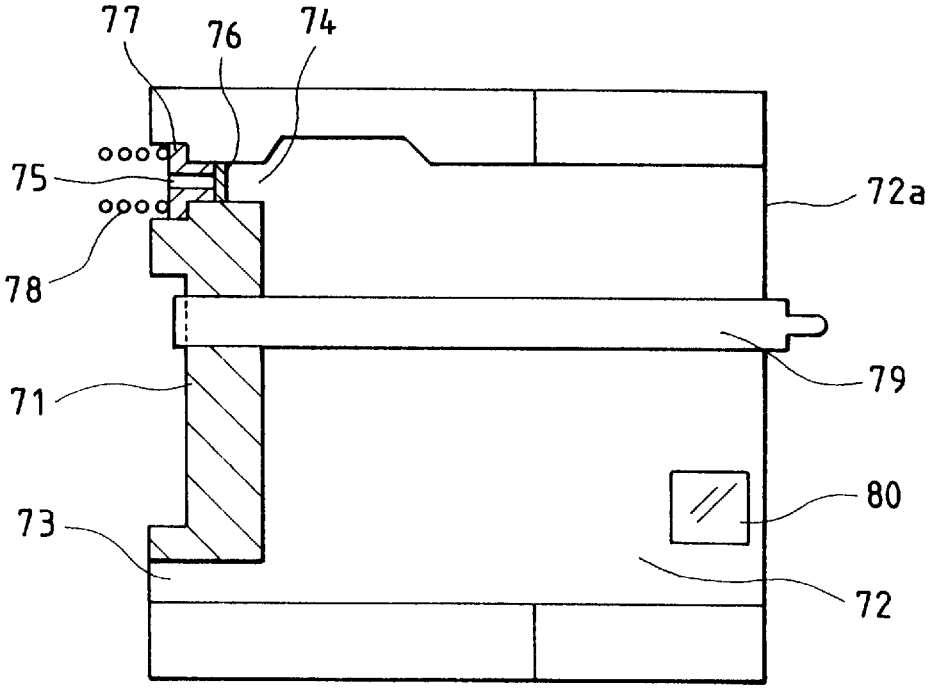
FIG. 7 is a drawing showing the structure of a subtank.

As shown in FIG. 7, a pipe 73 inserted into a connection port 70 (see FIG. 5) formed in the port 63*b* of the flow passage component 60 is disposed on the front bottom portion of the frame 71 and an air vent opening 74 is disposed on the top. A valve 77 formed with a through hole 75 and having a tip on which a film 76 made of permeable and water-repellent fluororesin, etc., is put is inserted into the opening 74 in a state in which it is pressed down by a spring 78 for opening the valve 77 when the inside becomes a given pressure.

A sensing piece 79 having one end fixed to the frame 71, the opposed end extending to detection means 85, and the center always coming in elastic contact with the side of the film 72 is disposed to sense a state in which the subtank 10 fills with ink, namely, an ink full state. Further, a light transmission region 80 is provided at the lower part near the turn 72*a* for detecting a state in which ink runs out in the subtank 10, namely, an ink empty state.

If a synthetic resin film coated with aluminum, etc., which is used to provide non-permeability, is used as the flexible film 72, the light transmission region 80 can be simply formed by preventing the region 80 from becoming coated with the aluminum synthetic resin film. Since the light transmission region 80 is formed near the turn 72*a*, if the subtank 10 becomes close to the ink empty state, ink is excluded due to elastic energy of the film at the turn 72*a* and the films are brought into intimate contact with each other, so that the ink existing between the films is excluded and the degree of light absorption by the pigment forming the ink is reduced, thus enabling reliable detection of the ink empty state.

Referring again to FIG. 6, numeral 82 is a protective case. As the ink full sensor 43 and the ink empty sensor 44 (see FIG. 4), sensors 85 and 86 for detecting a movement of the sensing piece 79 and the presence or absence of light transmitting through the light transmission region 80 are disposed in through holes 83 and 84 made in positions facing the sensing piece 79 and the light transmission region 80 when the protective case 82 is fitted into the flow passage component 60. The ink empty sensor 44 consists of a pair of a light emitting elements for emitting light with a long wavelength such as infrared rays indicating a large light absorption degree for the pigment contained in ink and a light receiving element having sensitivity for long light. Numeral 88 is a recess for housing the spring 78.

Figure 8:
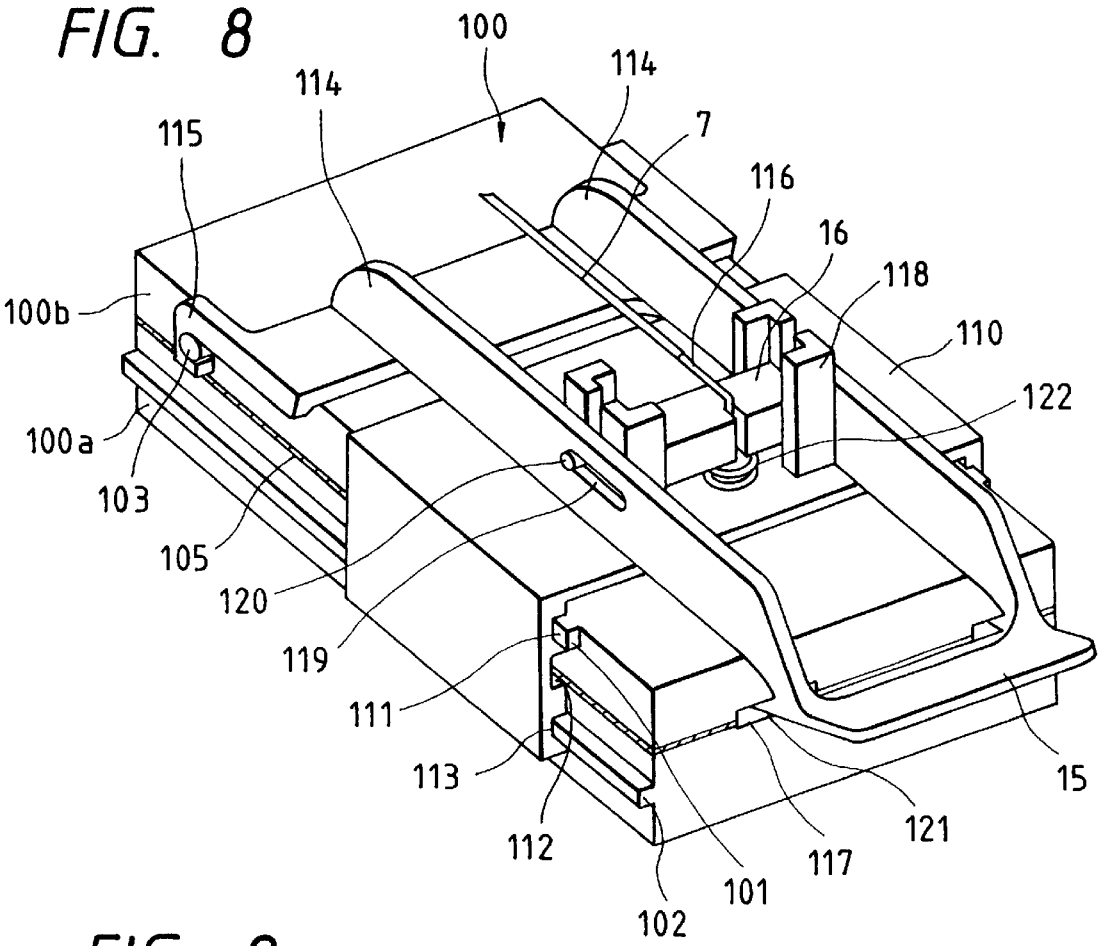
FIGS. 8 and 9 are a perspective view and a top view, respectively, showing one embodiment of an ink cartridge.
Figure 9:
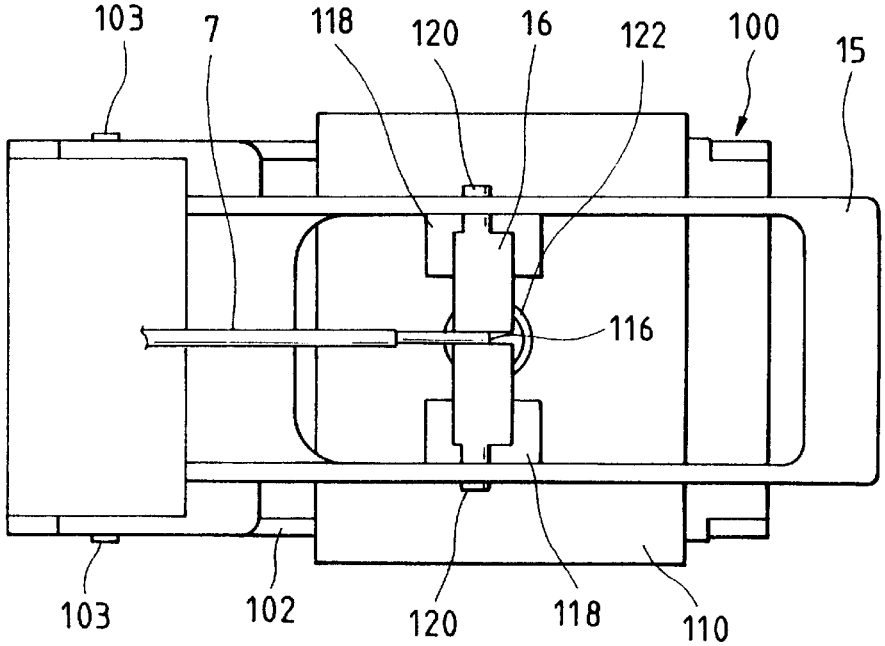

FIGS. 8 and 9 show one embodiment of the above-mentioned ink cartridge 6, wherein numeral 100 is a cartridge containing the ink bag 41, formed as a case containing a main unit 100*a* and a lid 100*b* joined by bond means that cannot be stripped off during the operation, but can be stripped off by a jig, etc., such as double-acting adhesive tape, so as to communicate with the air pump 40 in the internal space 6*a*.

The cartridge 100 has both sides formed with protrusions 101 and 102 selectively engaging grooves 111, 112, and 113 of a cartridge holding frame 110 (described below) and a rear end formed with a projection 103 engaging a recess 115 on the rear end of a lever 114. The top face of the cartridge holding frame includes an insertion hole (not shown) of an ink supply needle 116 connected to the tip of the tube 7 and a front face formed with a recess 117 for locking the lever 114.

Figure 10:
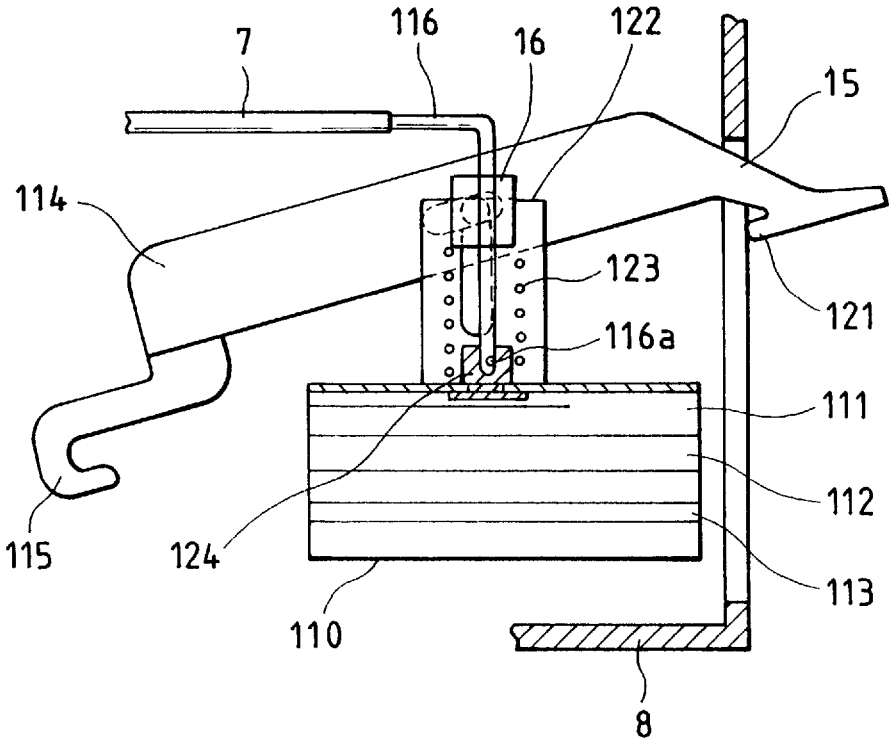
FIG. 10 is an illustration showing a state in which an ink cartridge is not mounted.

Numeral 16 is an insertion member of the above-mentioned ink supply needle. The ink supply needle insertion member 16 is movably attached to a guide member 118 formed on the top face of the cartridge holding frame 110 with a needle protective member 122 (described below) sandwiched between the insertion member 16 and the cartridge holding frame 110. The insertion member has both sides formed with projections 120 engaging long holes 119 of the lever 114 and moving up and down following rotation of the lever 114. As shown in FIG. 10, the needle protective member 122 consists of an elastic member 123 such as a spring for always pressing the ink supply needle insertion member 16 upward and a packing member 124 placed in a lower part for elastically sealing a needle hole 116*a* and the needlepoint of the ink supply needle 116 when the ink supply needle 116 is at an upper position.

Numeral 114 is the above-mentioned lever whose center engages the ink supply needle insertion member 16 via the long hole 119 and whose rear end includes a recess 115 for engaging the projection 103 of the cartridge 100 and for pivoting about the projection 103, with the projection as a supporting point. Disposed on the front of the lever 114 are a handle 15 that can be pressed down from the outside of the printer box 18 and a claw 121 fitted into the recess 117 of the cartridge 100 at a position where it is completely lowered.

When the ink cartridge 100 is not mounted (FIG. 10), the needle hole 116*a* and the needlepoint of the ink supply needle 116 are surrounded by the packing member 124.

Thus, even if a person touches the ink supply needle 116 carelessly, he or she is not injured with the needlepoint, and volatilization of the ink solvent and adhesion of dust can be prevented.

Figure 11:
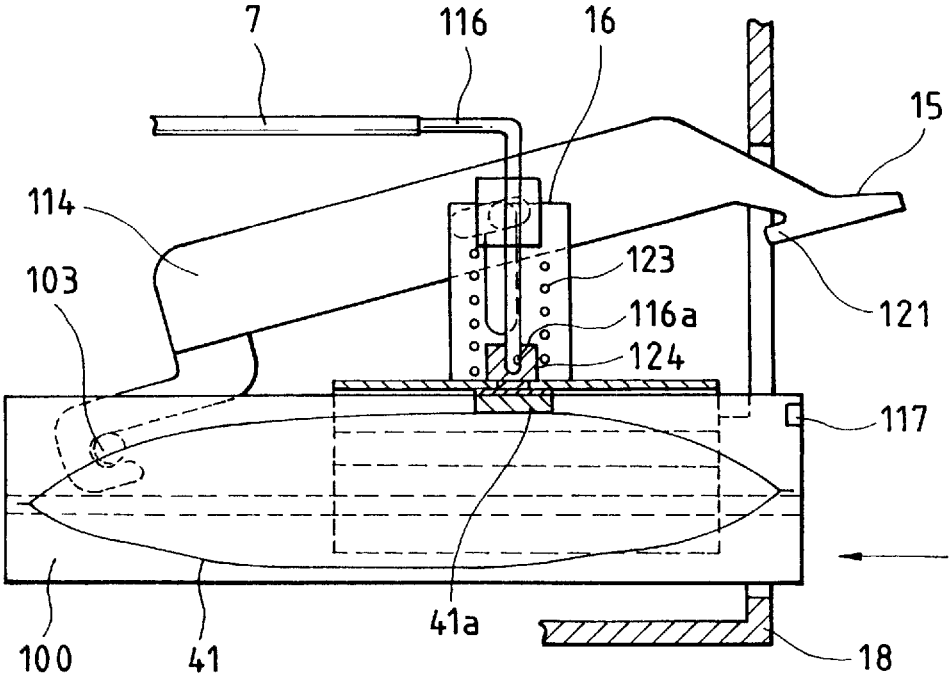
FIG. 11 is an illustration showing a state in which an ink cartridge is mounted and an ink supply needle is not inserted.

If the ink cartridge 100 is inserted matching with the grooves 111, 112, and 113 of the cartridge holding frame 110 through a cartridge insertion window of the printer box 18, it is guided by the holding frame 110 for moving to the depth. In this process, the projection 103 is fitted into the recess 115 of the lever 114, thus stopping the movement of the cartridge 100 (FIG. 11).

Figure 12:
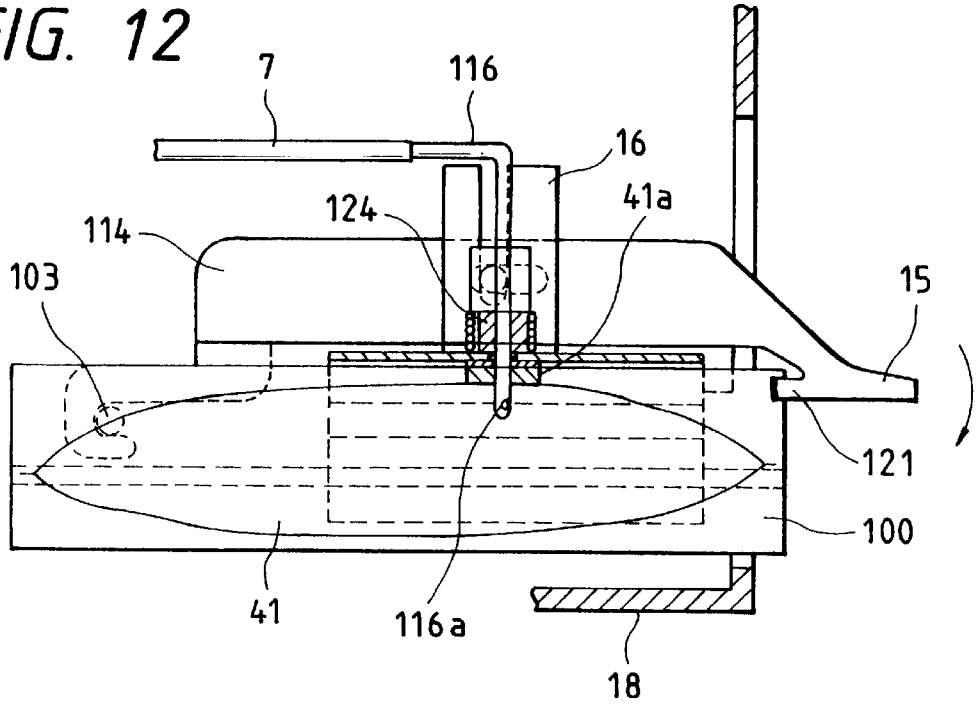
FIG. 12 is an illustration showing a state in which an ink supply needle is inserted.

When the lever 114 is pressed down, the ink supply needle 116 projects from the packing member 124 against the elastic member 123 and is inserted into the ink bag 41 airtightly through a packing member 41*a* of the ink bag 41 from the insertion hole of the cartridge 100. While the ink supply needle 116 projects from the packing member 124, dust, ink dregs, etc., adhering to the needlepoint are swept away with the packing member 124, preventing foreign material from getting mixed with ink in the ink bag 41. When the lever 114 is further pressed down, the claw 121 engages the recess 117 on the front of the cartridge 100 for fixing the lever 114 to the cartridge 100, preventing the ink supply needle 116 from being drawn out carelessly, and the cartridge 100 is pressed by the lever 114, thus preventing the cartridge from being taken out (FIG. 12).

On the other hand, when ink in the ink bag 41 has been consumed, if the lever 114 is pulled up against the engagement force of the claw 121, the claw 121 becomes elastically deformed and is detached from the recess 117 of the cartridge 100. When the lever 114 is furthermore pulled up to the upper limit, the ink supply needle insertion member 16 is pulled up by the lever 114 and the needlepoint is housed in the packing member 124. The cartridge 100 is taken out from the cartridge holding frame 110, a new cartridge 100 is mounted on the cartridge holding frame 110, and the lever 114 is pressed down to the lower limit. The cartridge replacement is now complete.

Figure 13:
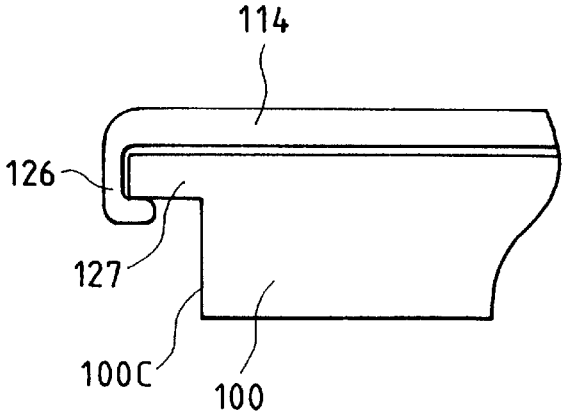
FIG. 13 is a side view showing another embodiment of the ink cartridge.

Although the projections 103 and 103 are formed on both sides near the rear end of the cartridge 100 for forming the pivot supporting point of the lever 114 in the embodiment, as shown in FIG. 13, a similar effect can also be produced by extending a part of the lever 114 so as to reach a rear end 100*c* of the cartridge 100 for forming a pivot supporting point formation part 126 and by forming the rear end 100*c* of the cartridge 100 with a thin part 127 capable of engaging the pivot supporting point formation part 126.

Figure 14:
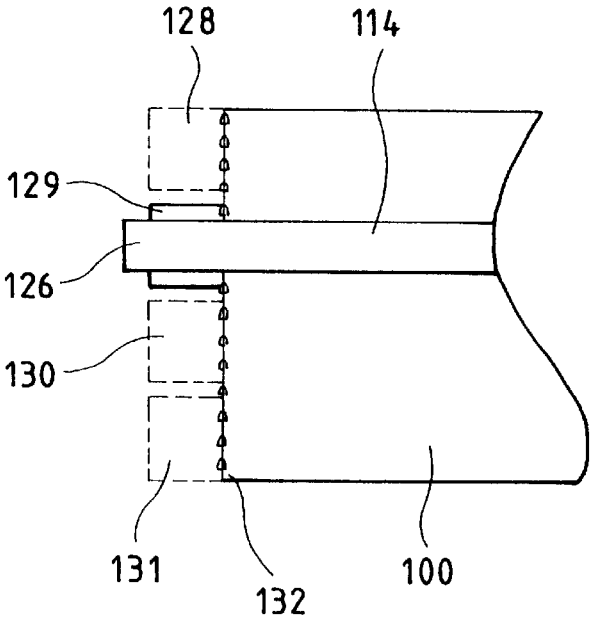
FIG. 14 is a top view showing an embodiment for applying the ink cartridge to color ink.

By the way, since different types of ink are supplied by different cartridges at a color printer, color mixture occurs if cartridges of different colors are mounted to the same ink supply needle. FIG. 14 shows an embodiment suitable for use of ink cartridges having the same outer form as supply means for different colors, wherein numerals 128 to 131 are thin parts spaced from each other capable of engaging the pivot supporting point formation part 126 formed on the rear end of the cartridge 100. Slits 132 are formed between the thin parts and the main unit of the cartridge 100 so as to be broken off by a bending force which is greater than the torque received from the lever 114.

According to the embodiment, different positions of the pivot supporting point formation part 126 of the lever 114 are set for each color of ink, and only a specific thin part is left for each ink color and others are cut off from the slits 132 on the cartridge side.

If a cartridge of a different color is inserted, the pivot supporting point formation part 126 of the lever 114 does not engage the thin part. Even if the lever 114 is pressed down, a force sufficient for pressing down the ink supply needle 116 against the elastic member 123 cannot be given, thus the ink supply needle 116 can be prevented from being inserted into a different color cartridge.

According to the embodiment, ink cartridges mass produced as consumables are manufactured with the same metal mold and when ink color is determined, the thin parts 128–131 may be cut off, thus manufacturing costs can be reduced owing to use of common metal molds to the cartridges. In the embodiment, the cartridge 100 is separated into two members, which are joined as a unit by bond means that can be stripped off. Therefore, if a cartridge with consumed ink is collected and is separated into the main unit 100*a* and the lid 100*b* with a jig, it can be recycled simply by replacing the ink bag 41.

Figure 15A:
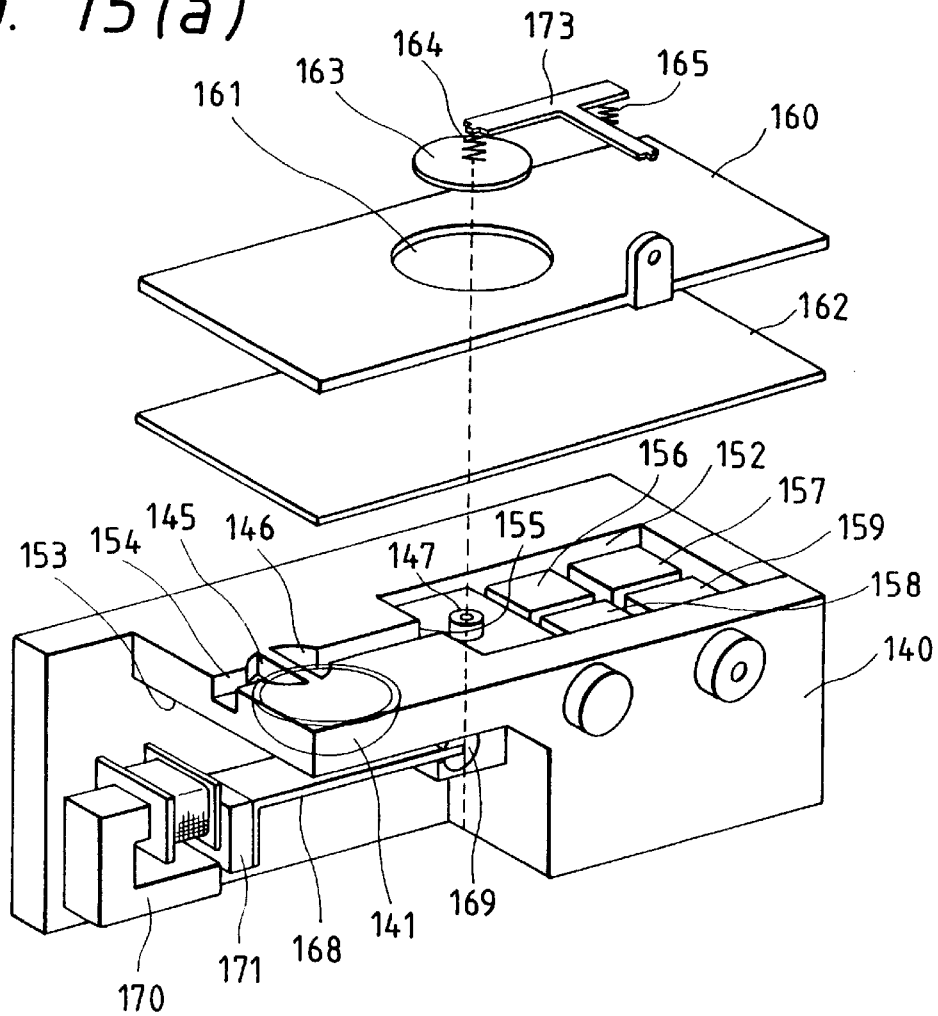
FIGS. 15(*a*) and (*b*) are a perspective view of assembly and a sectional view, respectively, showing one embodiment of an air pump.
Figure 15B:
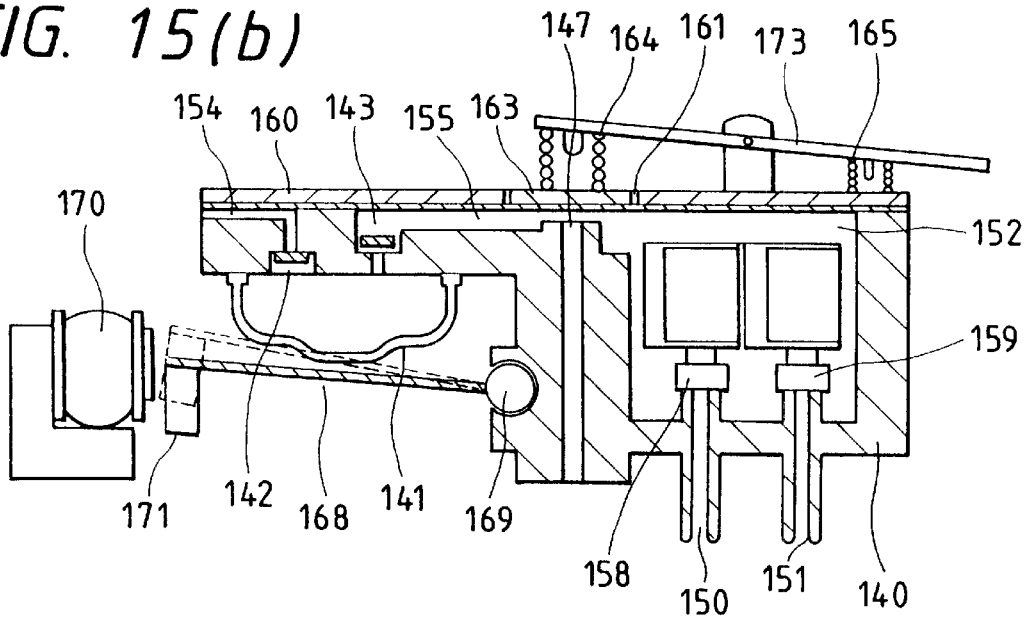

FIG. 15(*a*) and (*b*) show one embodiment of the air pump 40, wherein numeral 140 is a base. The top face of the base 140 is formed with check valve chambers 145 and 146 for housing two check valves 142 and 143 making up a pump together with a diaphragm 141 described below, an atmosphere communication port 147 used as a valve seat of a pressure regulation valve, and an electromagnetic valve chamber 152 comprising outlets 150 and 151 connected to each cartridge 6 on the lower end. The diaphragm 141 made of an elastic material such as rubber is fixed in airtight relation to a bottom face 153 opposed to the check valve chambers 145 and 146.

The check valve chamber 145 serving as a suction port communicates with the atmosphere via a groove 154 and the check valve chamber 146 serving as a discharge port communicates with the electromagnetic valve chamber 152 via a groove 155. The electromagnetic valve chamber 152 is provided with a plurality of exhaust ports on the bottom (in the embodiment, four exhaust ports 150 and 151) as described above, which are provided sealably with electromagnetic valves 156–159.

Numeral 160 is a lid formed with a window 161 in a part opposed to the atmosphere communication hole 147 serving as the valve seat for sealing the top face of the main unit case 140 via a packing plate 162 capable of covering at least the peripherals and openings. Numeral 163 is a pressure plate inserted into the window 161 for bringing the packing plate 162 into elastic contact with the through hole 147 under a constant pressure determined by springs 164 and 165.

Numeral 168 is a diaphragm drive piece having one end pivotably fixed to the base 140 via an elastic member 169 such as rubber and the other end to which a magnet 171 receiving an alternating field from a solenoid 170 is fixed so as to always come in contact with the diaphragm 141. Numeral 173 is a pressure regulation rod pivotably disposed on the lid 160.

When an alternating current is supplied to the solenoid 170 in the structure, the diaphragm drive piece 168 vibrates with the elastic member 169 side as a supporting point, compressing and expanding the diaphragm 141. If compressed air is supplied from the check valve 143 to the electromagnetic valve chamber 152 and the air pressure exceeds the pressure set by the springs 164 and 165, the pressure plate 163 moves upward against the pressure of the springs 164 and 165, letting a part of air escape from the through hole 147 for maintaining the air pressure in the electromagnetic valve chamber 152 to a given value, namely, an appropriate value for pushing up ink to the recording head 8 from the cartridge 6 (in the embodiment, gage pressure 0.02 to 0.04 ($kg/cm^2$)).

If the electromagnetic valves 156–159 are opened in this state, pressure-regulated air flows from the exhaust ports 150 and 151 into the airtight space 6*a* of the cartridge 6, whereby the ink bag 41 is compressed, making ink flow into the recording head 8 through the tube 7 and further flow from the recording head 8 into the subtank 10. When the ink full sensor 43 senses that the subtank 10 fills with ink, the electromagnetic valves 156–159 are closed. If the ink full sensor 43 does not sense the ink full state after a predetermined time has elapsed, it is judged that the remaining amount of ink in the ink cartridge 6 has become extremely small.

Ink in the subtank 10 reversely flows via the recording head 8 into the ink cartridge 6 due to the head difference (in the embodiment, 10 cm H2O). If the ink empty sensor 44 detects an ink empty state, the electromagnetic valves 156–159 are opened, again supplying air to the ink cartridge 6 for supplying ink via the recording head 8 to the subtank 10 until it fills with ink. Thus, the ink amount in the subtank 10 is maintained in a predetermined range for printing while the electromagnetic valves 156–159 are opened and closed in response to the signals of the ink empty sensor 44 and the ink full sensor 43.

Next, auxiliary members disposed in the nonprint area for supporting the ink supply system will be discussed.

Figure 16:
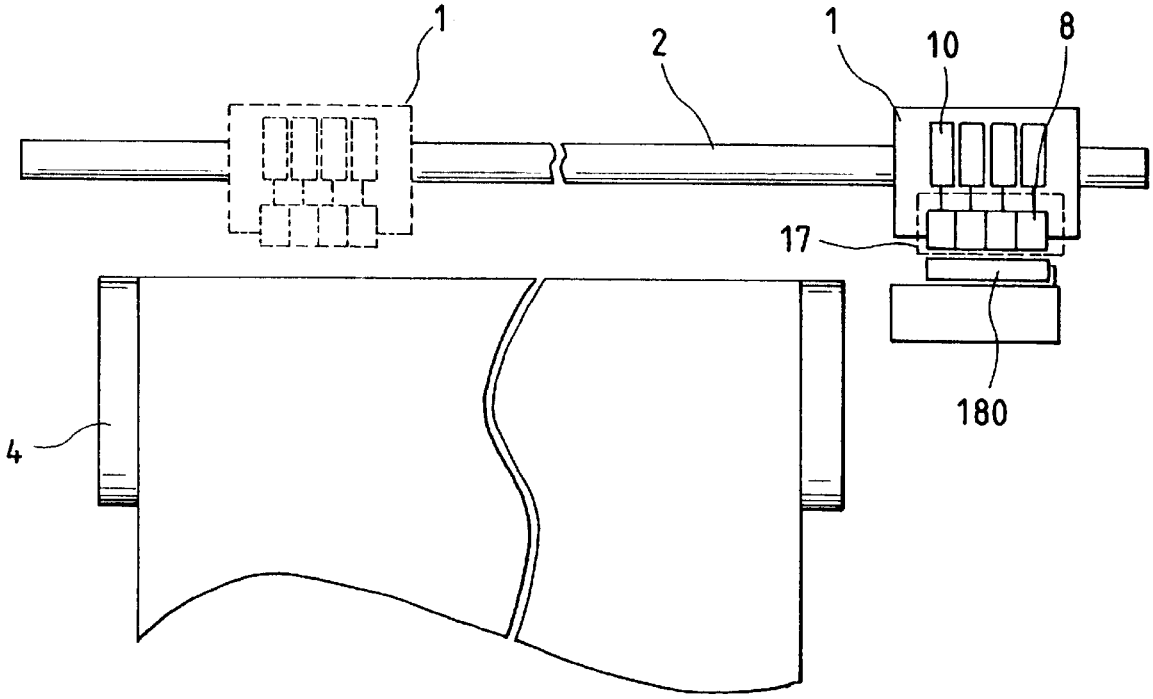
FIG. 16 is an illustration showing an arrangement of members placed in a nonprint area.

FIG. 16 shows an arrangement of the members in the direction of movement of the carriage 1 in the recorder, wherein numeral 180 is a capping means for sealing the recording head 8 and numeral 17 is a waste ink tank for storing ink discharged from the recording head 8. The capping means 180 and the waste ink tank 17 are placed outside the print area of the carriage 1. The capping means 180 is placed to a height opposite to the recording head 8 and the waste ink tank 17 is placed just below the capping means 180.

Figure 18:
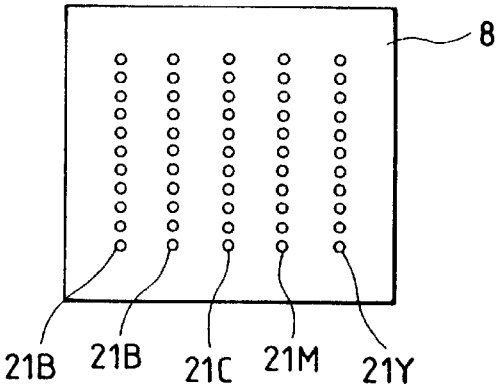
FIG. 18 is an illustration showing an arrangement of nozzle openings of a recording head.
Figure 17:
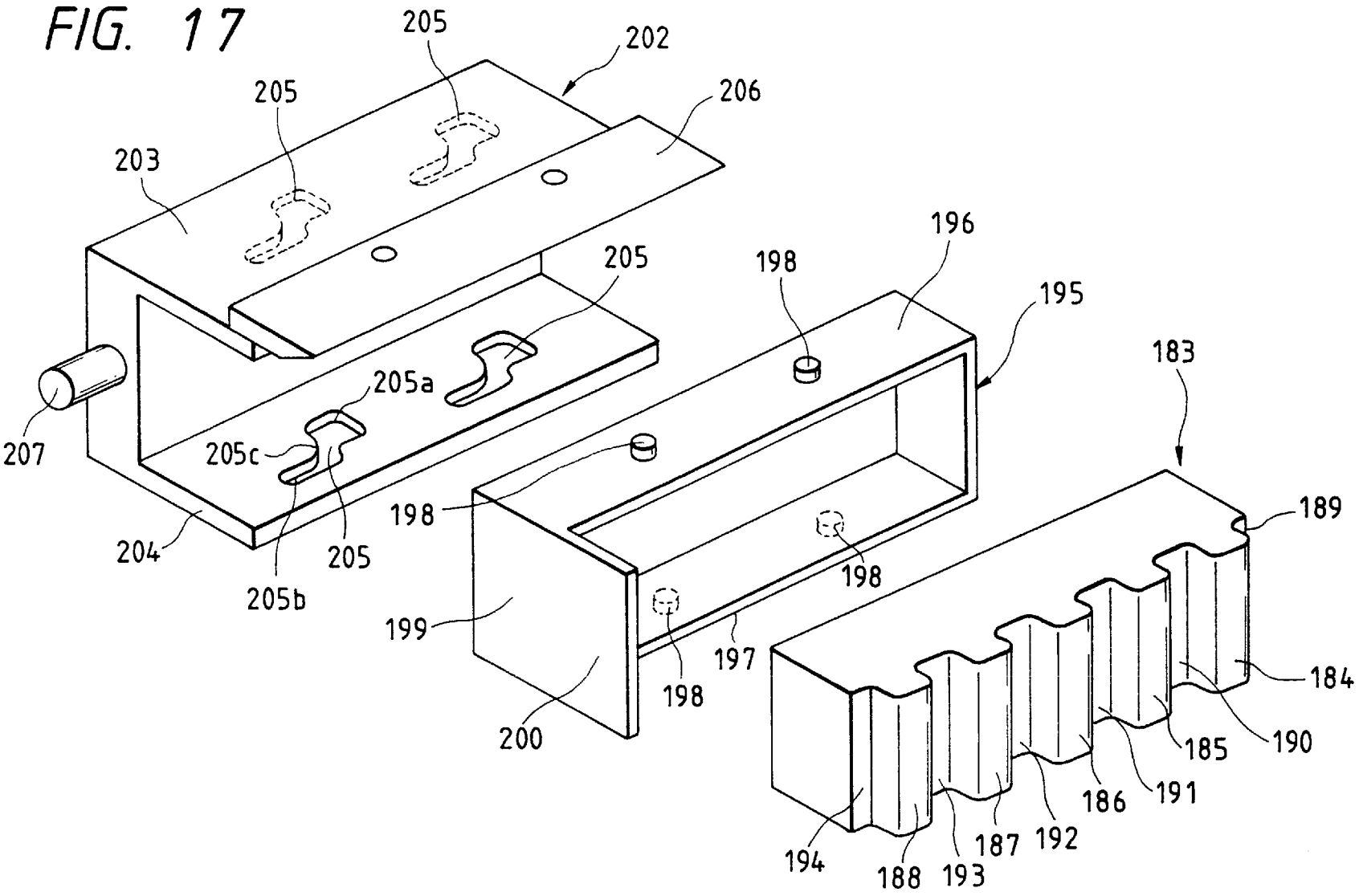
FIG. 17 is a perspective view of assembly showing one embodiment of capping means.
Figure 22:
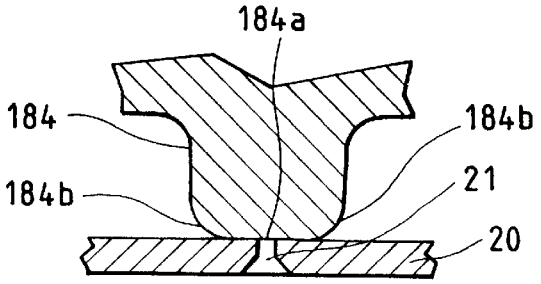
FIG. 22 is a drawing showing a state in which nozzle openings are sealed with a cap member.

FIG. 17 shows one embodiment of the capping means, wherein numeral 183 is a cap member formed with a plurality of projections so as to match the arrangement of nozzle openings 21B of the recording head 8 for spouting black ink drops, nozzle openings 21C for spouting cyan ink drops, nozzle openings 21M for spouting magenta ink drops, and nozzle openings 21Y for spouting yellow ink drops (FIG. 18) (in the embodiment, projections 184 and 185 seal two rows of the nozzle openings 21B for spouting black ink drops and projections 186, 187, and 188 seal the nozzle openings 21C, 21M, and 21Y for spouting color ink drops. For example, the projection 184 will be discussed for providing a plane at the center abutting the nozzle openings and rounding so as to dent to the recess side on the boundaries between the projection and recesses 190–194. As seen in FIG. 22, the projection 184 is made of a chemically resistant silicon-family rubber having a JIS hardness of 40 to 60, preferably 60 so as to form a plane 184*a* at the center abutting the nozzle openings 21 and rounds 184*b* and 184*b* on both sides distant from the nozzle openings 21B.)

Numeral 195 is a cap member fixing frame formed as a frame which comes in elastic contact with the peripheral surface of the cap member 183 for holding the cap member 183 with the projections 184–188 exposed. It has a top face 196, a bottom face 197 formed with outwardly projecting projections 198, 198 spaced from each other at a given distance, and a side face 199, which is opposed to the recording head 8 and becomes the home position side. The side face 199 includes an abutment piece 200 which abuts the side of the recording head 8 when it moves to the capping position.

Numeral 202 is a cap member support formed as a frame having a "C"-shaped cross section with both sides and front opened. It has a top face 203 and a bottom face 204 formed with guide grooves 205 in which the projections 198 of the cap member fixing frame 195 are fitted. A blade 206 made of an elastic material such as rubber for coming in contact with the surface of the recording head 8 is fixed to the top face 203 side opposed to the recording head 8.

Each of the guide grooves 205 consists of two parallel parts 205*a* and 205*b* preceding and following in a direction perpendicular to the nozzle opening face of the recording head 8 and a slope 205*c* for guiding the projection 198 from one parallel part 205*a* to the other parallel part 205*b* when the cap fixing frame 195 moves in the horizontal direction. The cap member support 202 has both sides formed with a shaft 207 engaging a capping means drive mechanism described below.

Figure 19:
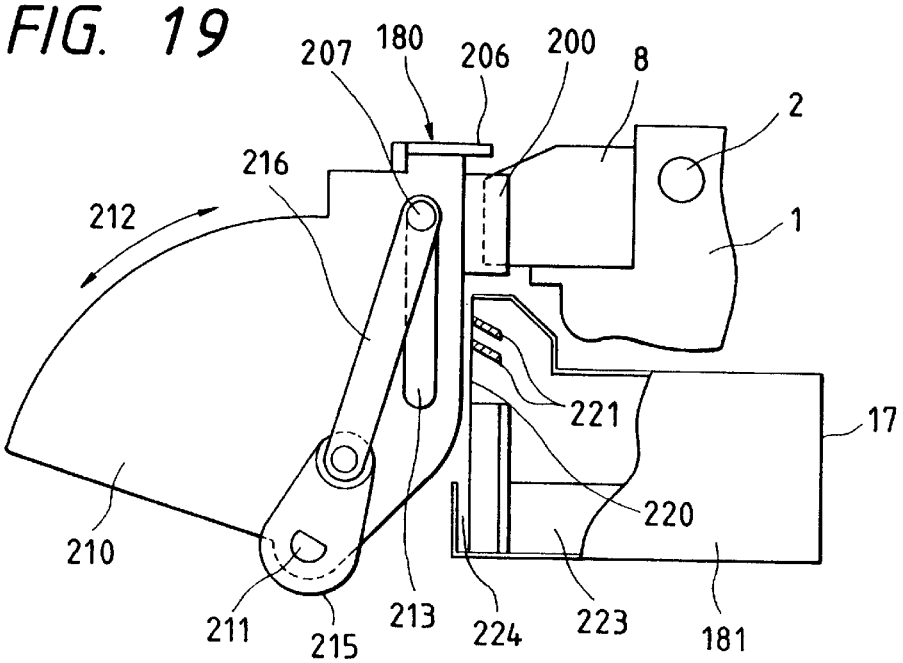
FIG. 19 is a drawing showing one embodiment of capping means and a waste ink tank placed in a nonprint area.

FIG. 19 shows one embodiment of the capping means 180 placed near the home position and the waste ink tank 17, wherein numeral 210 is the above-mentioned capping means drive mechanism rotated in the directions indicated by an arrow 212 by drive means (not shown) with a shaft 211 as the center for moving the capping means 180 between a position at which the capping means 180 is abutted against the recording head 8 and a position at which the capping means 180 is detached from the recording head 8. The shaft 207 of the cap member support 202 is guided by a long groove 213. A crank 215 rotates, whereby the cap member 183 is moved via a shaft 216 from the position opposed to the recording head 8 to a blade 221 of the waste ink tank 17.

Numeral 17 is the above-mentioned waste ink tank which has an opening 220 in the upper part of the face opposed to the cap member 183, in which the blade 221 coming in elastic contact with the projections 184–188 of the cap member 183 is disposed. The waste ink tank 17 contains an ink absorption material 223 described below.

Numeral 224 is a protective member made of an elastic porous substance incapable of producing fiber pieces, such as nonwoven cloth. It is housed in a part of the waste ink tank 17 so as to abut the cap member 183 and the blade 206 when the capping means 180 is pulled down to the lowest end. The protective member 224 is impregnated with liquid lacking an affinity for ink, such as silicon oil, as required.

In the embodiment, in the nonprint mode, as shown in FIG. 20(*a*), the capping means drive mechanism 210 is moved to the recording head 8 side with the cap member support 202 pulled up to the top part by the crank 215. The projections 184–188 are abutted against the nozzle openings 21B, 21B, 21C, 21M, 21Y of the recording head 8, whereby the nozzle openings 21B, 21B, 21C, 21M, 21Y are directly sealed by the plane 184*a* of the cap member 184 without any space therebetween, as shown in FIG. 22. Even if vibration is applied to the recording head 8 from the outside, unlike a cap formed like a cup, ink drops do not leak from the nozzle openings. Therefore, an extremely effective seal means is provided, particularly for ink high in film formation property and drying property. Since the rounds 184*b*, 184*b* are formed on both sides and the contact area is made as small as possible, the amount of ink remaining between the cap member 183 and the nozzle plate 20 can be reduced as much as possible for preventing ink fixation, which causes the cap to be fixed.

To start printing, when a print command signal is input, if the recording head 8 is moved to the print area side with the cap member 183 abutted against the recording head 8, the cap member 183 moves to the print area side as the recording head 8 moves. In this process, the projection 198 of the cap member fixing frame 195 moves from the parallel part 205*b* of the guide groove 25 via the slope 205*c* to the parallel part 205*a* and is detached from the recording head 8. In this state, as shown in FIG. 20(*b*), the capping means drive mechanism 210 is rotated in the direction of arrow A for detaching the capping means 180 from the recording head 8, whereby the recording head 8 is completely released from the capping means 180, thus enabling ink drops to be spouted through the nozzle openings 21B, 21B, 21C, 21M, 21Y in response to print data.

Figure 21A:
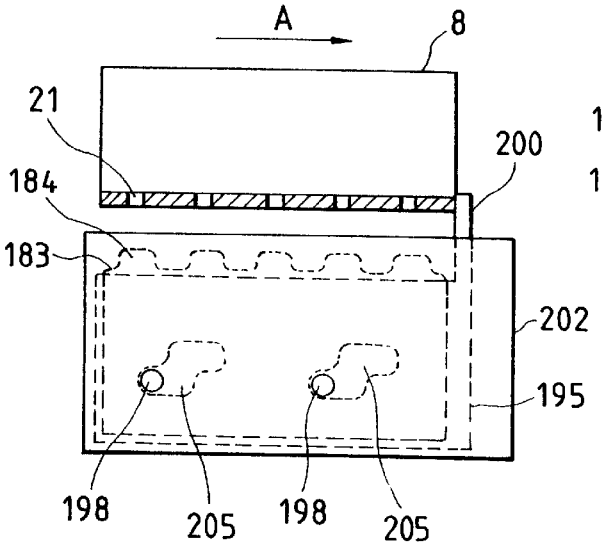
FIGS. 21(*a*) and (*b*) are illustrations each showing a process in which a cap member abuts the recording head.
Figure 21B:
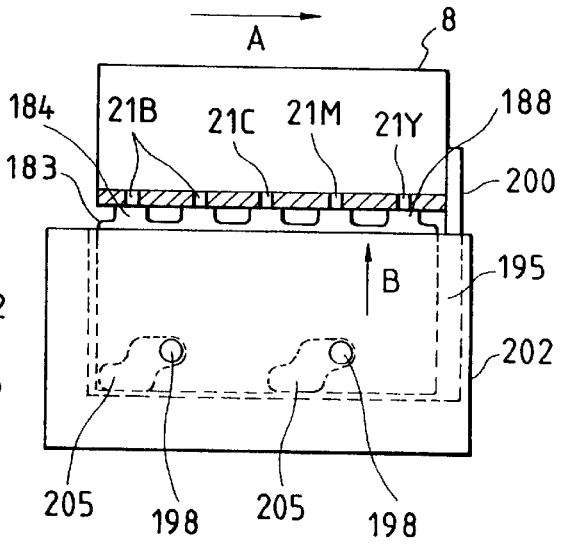
Figure 20A:
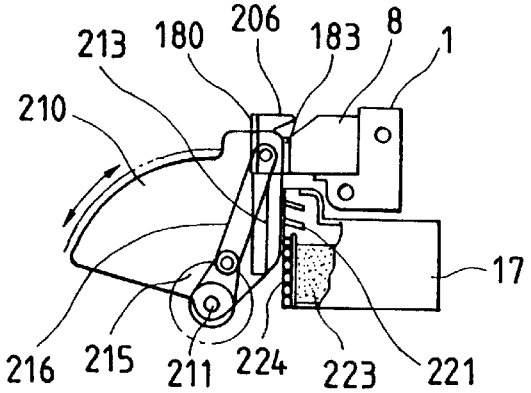
FIGS. 20(*a*) to (*d*) are illustrations showing the operation of the capping means.
Figure 20B:
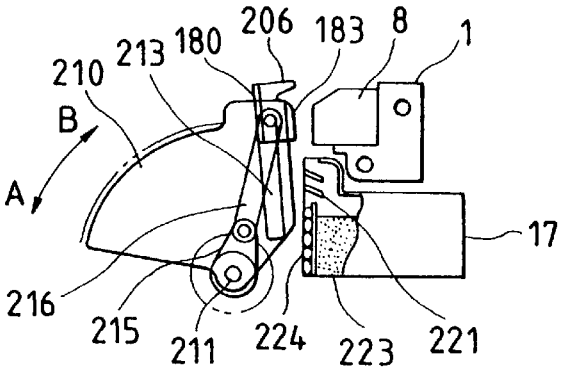
Figure 20C:
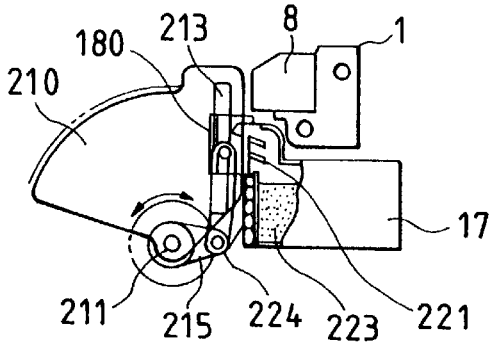
Figure 20D:
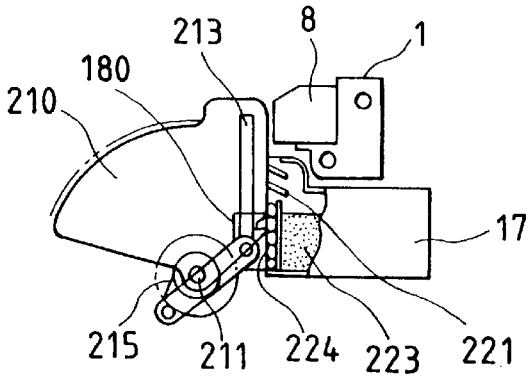

Upon completion of the printing, the capping means drive mechanism 210 is moved in the direction indicated by arrow B in FIG. 20(*b*) for moving the abutment piece 200 to a position at which the abutment piece 200 abuts the recording head 8. In this state, when the recording head 8 comes to a position near the capping position of the home position, the side of the home position of the recording head 8, which is moving in the direction A, abuts the abutment piece 200 (FIG. 21(*a*)), thus moving the fixing frame 195 relative to the support 202. The projections of the fixing frame 195 move to the parallel part 205*b* with the projection 198 guided by the slope 205*c*, and also advance to the recording head side while accurately positioning the horizontal position of the recording head 8 relative to the abutment piece 200, whereby the cap member 183 moves vertically to the nozzle openings as shown by arrow B in FIG. 21(*b*), while not moving in the horizontal direction relative to the recording head 8, for bringing the projections 184–188 into elastic contact with the nozzle openings 21B, 21B, 21C, 21M, 21Y (FIG. 21(*b*)). Since the horizontal relative rate between the recording head 8 and the cap member 183 is zero just before the abutment, the cap member 183 comes in elastic contact with the nozzle openings 21 without rubbing the recording head unnecessarily.

If the nozzle plate 20 is contaminated with ink dregs, dust, etc., because of long-term use, it needs to be cleaned.

With the cap member 183 brought into elastic contact with the nozzle plate 20 (FIG. 20(*a*)), the air pump 40 is operated for raising the pressure of the cartridge 6, making ink in the ink bag 41 flow into the recording head 8 through the tube 7. As the ink flows, bubbles on the flow passage of the tube 7, the recording head 8, etc., are discharged into the subtank 10 through the tube 9. If the cartridge 6 is pressurized for a predetermined time, the film 72 forming the subtank 10 swells, thus the ink full sensor 43 detects ink full. In this state, if the capping means drive mechanism 210 is driven for detaching the cap member 183 from the nozzle plate 20, ink flows out through the nozzle openings, forming an ink layer between the nozzle plate 20 and the cap member 183. When ink fixed on the surface of the nozzle plate 20 melts, the carriage 1 is reciprocated left and right at a distance of at least the length or more of the recording head 8, whereby the nozzle plate 20 is rubbed with the projections 184–188 of the cap member 183 via the ink layer, and the ink dregs and dust on the surface of the nozzle plate 20 are taken into, ink.

Although the cap member 183 is also used as the rubbing member in the embodiment, it is apparent that a similar effect can also be produced by an elastic plate for rubbing disposed at a predetermined position, such as the fixing frame 195, as is well known.

Upon completion of the rubbing, the carriage 1 is restored to the former position and stopped and the crank 215 is operated for moving the capping means 180 downward, whereby the blade 206 disposed at the capping means 180 wipes the surface of the nozzle plate 20 vertically for sweeping away ink on the surface of the nozzle plate 20. Since the wiping is executed in the nozzle opening arrangement direction of the same color, color mixture of ink occurring during the wiping is prevented.

During the wiping, the interference amount or gap $\Delta G_1$ between the nose of the blade 206 and the nozzle plate 20 is maintained to a distance capable of maintaining surface tension of ink, for example, 1 mm or less, and a distance capable of enabling an ink film to intervene between the nozzle plate 20 and the nose of the blade 206, and the relative rate of movement between the nozzle plate 20 and the blade 206, V, is set to a rate at which the blade 206 can adsorb and hold ink, for example, 3 mm/s or less, preferably 1 mm/s or less.

Since the blade 206 has a higher affinity for ink than the surface of the nozzle plate 20, which has been subjected to a treatment of removing an affinity for ink, so-called water repelling treatment, ink drops K flowing out through the nozzle openings 21 (FIG. 23(*a*)) are adsorbed on the nose of the blade 206 moving at rate V (FIGS. 23(*b*) and (*c*)) and move as a large clot L while being pulled by the moving blade 206, so that the adsorbed ink itself functions equally with the blade. Therefore, with continuous ink on the surface of the nozzle plate 20, the blade 206 is moved to the lower end of the nozzle plate 20 (FIG. 23(*d*)) in order to remove the ink from the nozzle plate 20, whereby the surface of the nozzle plate 20 can be prevented from being unnecessarily rubbed for prolonging the life of the water repelling layer.

Figure 24:
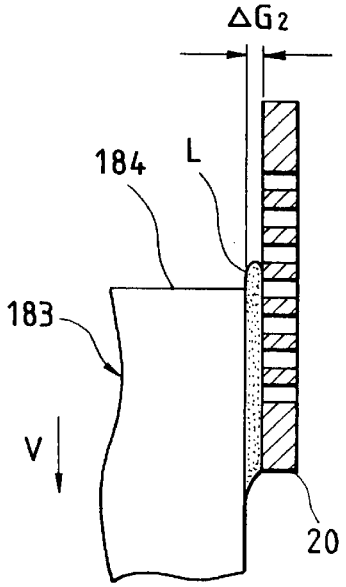
FIG. 24 is an illustration showing the wiping operation using the cap member.
Figure 23A:
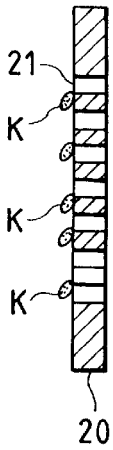
FIGS. 23(*a*) to (*d*) are illustrations showing the wiping operation of a blade.
Figure 23B:
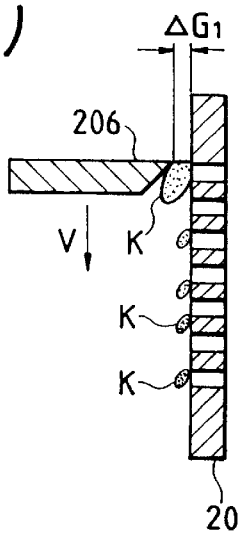
Figure 23C:
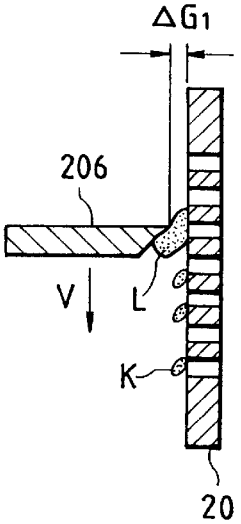
Figure 23D:
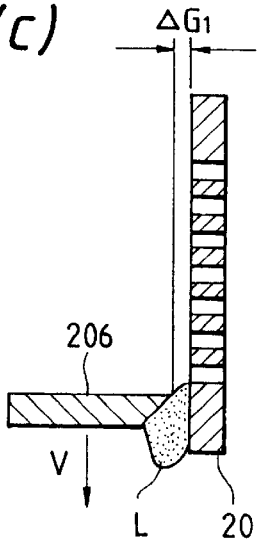

Originally, since the ink adsorption property difference between the moving member and the nozzle plate 20 is used, the nose of the moving member need not be formed like a blade. If the cap member 183 is dropped at the rate V by the crank 215 while gap $\Delta G_2$ is held between the surface of the projections 184–188 of the cap member 183 and nozzle plate 20 as shown in FIG. 24, at least the portion near the nozzle openings involved in printing can be cleaned.

The blade 206 and the cap member 183 moving downward relative to the nozzle plate 20 are furthermore brought down by the crank 215, and wiped by the blade 221 placed in the upper opening of the waste ink tank 17 (FIG. 20(*c*)) for sweeping away contaminated ink adhering to the surface.

Upon completion of the wiping, again the air pump 40 is operated for pressurizing the cartridge 6 and the above-mentioned capping operation is performed in the pressurization state, whereby the internal pressure near the nozzle openings rises, thus the projections 184–188 of the cap member 183 can be prevented from pushing air into the nozzle openings 21 as much as possible.

When the nozzle openings need not be sealed as in printing, etc., if the capping means 180 is pulled down to the lowest end position by the crank 215 (FIG. 20(*d*)), the cap member 183 abuts the protective member 224, whereby dust can be prevented from adhering to the cap member 183 and the blade 206, and ink dregs can be prevented from occurring due to ink drying.

Figure 25:
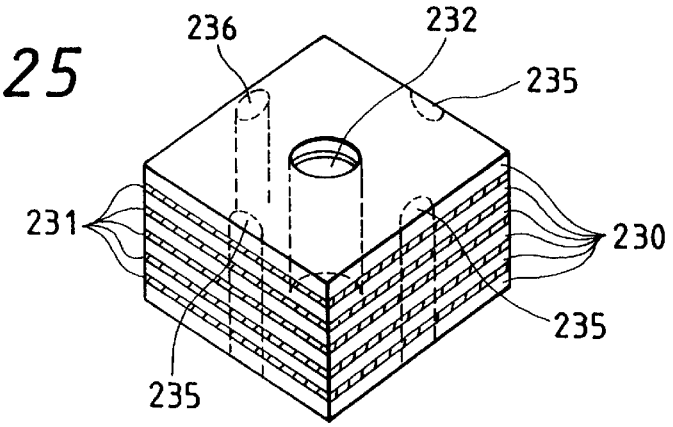
FIG. 25 is an illustration showing one embodiment of a waste ink absorption material housed in the waste ink tank.

FIG. 25 shows one embodiment of the ink absorption material housed in the waste ink tank 17 described above, wherein numerals 230, 230, . . . are ink absorption sheets each 0.1 mm to 0.5 mm thick provided by compressing fiber showing an affinity for ink so as to provide a density of about 200 g per cubic meter. A necessary number of sheets are laminated with partition sheets 231, 231, . . . made of ink-nonpermeable material, such as a metal foil or resin film. An inflow port 232 penetrating the ink absorption material from the top face to the bottom face is made in a position into which waste ink discharged from the recording head 8 flows (in the embodiment, the center of the ink absorption material).

Figures 26A, 26B, 26C:
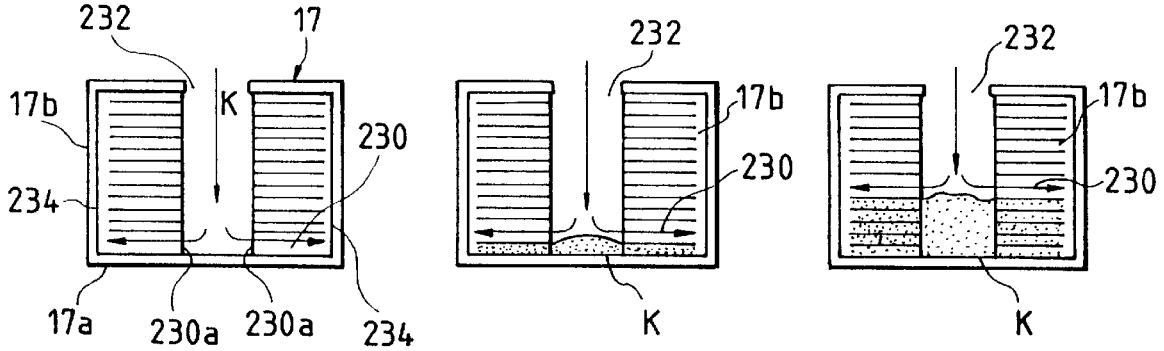
FIGS. 26(*a*) to (*c*) are illustrations showing a waste ink absorption process.

According to the embodiment, when ink discharged from the recording head 8 flows into the inflow port 232 (FIG. 26(*a*)), it is absorbed in all directions from the bottom face 17*a* of the waste ink tank 17 and an exposure face 230*a* of the through hole 232 at the center of the lowest ink absorption sheet 230. Since the lowest ink absorption sheet 230 is separated from the second ink absorption sheet 230 positioned thereabove by a partition sheet 231, the lowest sheet 230 absorbs waste ink K as much as possible while expelling air from a gap 234, whereby rapid fixation of ink caused by too rapid volatilization of the solvent making up a part of the waste ink can be suppressed, thus preventing the ink sheet from being clogged with fixed ink. Therefore, waste ink of an amount near the limit of the absorption capability of one ink sheet can be absorbed.

When the lowest ink absorption sheet 230 thus absorbs ink to its limit, the liquid level of the waste ink rises from the bottom face 17*a* to the second ink absorption sheet 230 (FIG. 26(*b*)), and the second ink absorption sheet absorbs waste ink of an amount near the limit of its absorption capability as described above. Thus, the ink is absorbed by successive ink sheets starting with the lowest sheet (FIG. 26(*c*)).

If the filling rate of each ink absorption sheet 230 is raised and the peripheral surface comes in contact with a wall face 17*b* of the waste ink tank 17 and the gap 234 cannot be provided, it is feared that air may remain in the ink absorption sheets 230, thus blocking the spreading of waste ink K in all directions through the inflow port 232. To solve such a problem, vertically continuous notches 235, 235, . . . and small through holes 236 (FIG. 25) are provided on the peripheries of the ink absorption sheets 230 and the partition sheets 231, thereby providing permeability on the fringes of the ink absorption sheets 230.

Figure 27:
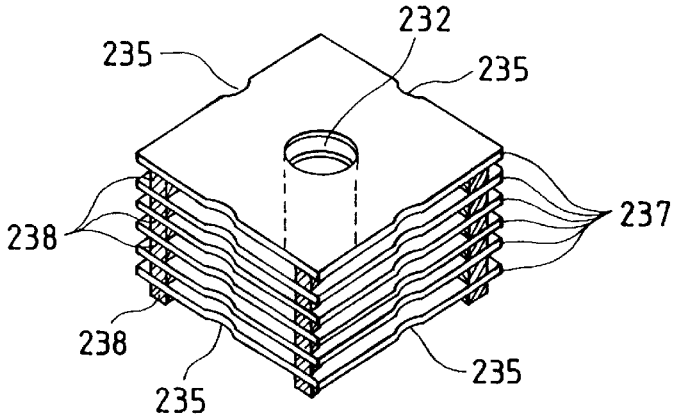
FIG. 27 is an illustration showing another embodiment of the waste ink absorption material.

FIG. 27 shows another embodiment of the waste ink absorption material. In this embodiment, only partition sheets 237 not absorbing ink are laminated via spacers 238 so that they are spaced from each other, normally 1 mm or less, in order to allow the ink to be held by a capillary force. Numeral 235 is an air vent recess made in the fringes.

According to this embodiment, waste ink flowing in through an inflow port 232 flows into a gap formed by the lowest partition sheet 237 and spreads in all directions and the solvent volatilizes, then only the solid component remains on the partition sheet 237. When one gap is thus filled with the solid component, ink flows into another gap above the gap filled with the solid component. This process is repeated for efficiently storing waste ink. Particularly for ink fast in fixation or containing much solid component, the waste ink absorption material can absorb waste ink more efficiently than the absorption material using compressed fiber.

In the invention, ink is supplied from the ink cartridge via the recording head to the subtank, and further during printing, ink in the subtank is made to reversely flow into the ink cartridge via the recording head. Therefore, ink can be circulated in one flow passage without complicating the ink flow passage, accumulation of ink in the recording head can be removed, and bubbles and viscous ink in the flow passage can be discharged for supplying ink at a concentration appropriate for printing to the recording head.

Although the invention has been described in detail in connection with a preferred embodiment of the same, it will be recognized by those skilled in the art that various changes and modifications can be made without departing from its scope.

We claim:

1. An ink jet recorder comprising a subtank and an ink jet recording head mounted on a carriage moving in parallel with a platen, an ink cartridge being placed outside said carriage for communicating with said ink jet recording head by a tube, ink supply means for feeding ink from said ink cartridge into said recording head under pressure, capping means for sealing nozzle openings of said recording head outside a print area of said carriage, and a waste ink tank for storing waste ink from said recording head, characterized in that said ink jet recording head comprises two common ink chambers in communication with both sides of pressure generation chambers and ink supply ports where ink flows into said common ink chambers from a position outside of said ink jet recording head, one ink supply port being connected to said subtank and the other being connected to said ink cartridge, wherein said subtank is replenished with ink through said ink jet recording head by said ink supply means and ink is made to reversely flow into said ink cartridge via said recording head from said subtank for printing.

2. The ink jet recorder as claimed in claim 1, wherein said subtank and said recording head are joined as a unit by a flow passage component, wherein said flow passage component includes a flow passage having at least one groove and at least one flexible film for sealing said at least one groove, and wherein said subtank and said recording head are connected by the flow passage.

3. The ink jet recorder as claimed in claim 2, wherein a filter is inserted between said recording head and said flow passage component.

4. The ink jet recorder as claimed in claim 1, wherein said subtank is provided with at least a part comprising a flexible film, a responsive piece responsive to expansion of the flexible film at an ink full position, and a light transmission region at an ink empty position, and wherein a movement of said responsive piece and an infrared ray transmission factor of said light transmission region are detected for sensing an ink full state and an ink empty state.

5. The ink jet recorder as claimed in claim 4, wherein an ink outlet is disposed in a lower part of said subtank and an air vent hole sealed with a packing lacking an affinity for ink and having permeability is disposed in an upper part of said subtank.

6. The ink jet recorder as claimed in claim 4, wherein said flexible film is airtightly joined to a frame so as to provide a triangular cross section, and said light transmission region is formed near the end.

7. The ink jet recorder as claimed in claim 1, further including a holding frame for detachably holding said ink cartridge, a lever rotatably disposed on said holding frame, and an ink supply needle connected to said recording head by said tube, wherein said ink supply needle moves up and down with a rotation of said lever.

8. The ink jet recorder as claimed in claim 7, wherein said lever has one end formed with an engagement part for engaging said ink cartridge when said cartridge is normally mounted, and said engagement part is used as a rotation supporting point.

9. The ink jet recorder as claimed in claim 7, wherein when said ink supply needle is pulled up from said cartridge between said lever and said holding frame, a tip of said ink supply needle is surrounded by an elastic member and when said lever is pulled down, said ink supply needle projects from the elastic member and is inserted into an ink bag.

10. The ink jet recorder as claimed in claim 7, wherein a claw projecting into the side of said ink cartridge is formed on a rotation operation side of said lever, wherein a recess is formed in said cartridge at a position opposed to said claw when said ink supply needle of said cartridge is inserted into the ink bag, and wherein said claw elastically engages said recess when said ink supply needle is inserted in the ink bag.

11. The ink jet recorder as claimed in claim 1 wherein said ink cartridge comprises a flexible ink bag housed in a sealable vessel and wherein said ink supply means is formed as an air pump for supplying air to said vessel.

12. The ink jet recorder as claimed in claim 11, wherein said ink supply means comprises:

a base formed with two check valve chambers for housing check valves for suction and exhaust, said check valve chambers opening up to a face of said base;

an electromagnetic valve chamber in communication with one of said check valve chambers by a groove, and housing electromagnetic valves for sealing exhaust ports;

an atmosphere communication hole communicating with said electromagnetic valve chamber and having a top face serving as a valve seat, said atmosphere communication hole made in said base;

an airtight diaphragm in communication with said check valve chambers at positions opposed to said check valve chambers on an opposed face of said base via through holes, said diaphragm being expanded and shrunk by an electromagnetic means;

a lid formed with a window in a position opposed to a top face of said atmosphere communication hole for sealing the opening of said top face via a packing plate, and a pressure plate for pressing the packing plate via elastic members so as to provide a constant pressure in an area opposed to the window.

13. The ink jet recorder as claimed in claim 12, wherein said exhaust ports are connected to a space of said cartridge by the flow passage.

14. The ink jet recorder as claimed in claim 13, wherein pressure of the space of said ink cartridge is adjusted by said elastic members to a pressure appropriate for supplying ink to said recording head.

15. The ink jet recorder as claimed in claim 1, wherein said capping means is disposed in a non-print area of said carriage and has a cap member made of an elastic substance comprising projections at positions corresponding to nozzle opening rows of said recording head.

16. The ink jet recorder as claimed in claim 15, wherein said elastic substance is made of chemically resistant silicon-family rubber having hardness of JIS hardness 40 to 60, preferably 60.

17. The ink jet recorder as claimed in claim 15, wherein each of said projections is formed so as to have a semicylindrical cross section, wherein said cross section comprises a plane part abutting the nozzle openings and round parts disposed adjacent to said plane part.

18. The ink jet recorder as claimed in claim 15, wherein said capping means is disposed in a capping means drive mechanism so as to move in a direction substantially perpendicular to a face of the nozzle plate and in a direction substantially perpendicular to a move direction of said carriage, wherein said direction is substantially parallel with a plane containing the nozzle plate.

19. The ink jet recorder as claimed in claim 15, wherein said cap member is disposed in the capping means drive mechanism via a fixing frame, and is movable in a direction of movement of said recording head and in a direction perpendicular to the nozzle plate, and wherein as said recording head moves, said projections are brought into elastic contact with the nozzle openings perpendicularly to the nozzle plate.

20. The ink jet recorder as claimed in claim 19, wherein the fixing frame has an abutment piece abutting a side of said recording head when the nozzle plate of said recording head is opposed to said cap member.

21. The ink jet recorder as claimed in claim 19, wherein a blade positioned opposite the nozzle openings of the nozzle plate is disposed on an upper end of the fixing frame.

22. The ink jet recorder as claimed in claim 1, wherein said waste ink tank for storing ink discharged from said recording head is disposed in the non-print area of said carriage and contains ink absorption material having a plurality of layer-like ink absorption regions separated from each other in a vertical direction by ink non-transmission material.

23. The ink jet recorder as claimed in claim 22, wherein the ink absorption regions are filled with porous material.

24. The ink jet recorder as claimed in claim 22, wherein the ink absorption regions are formed as a gap allowing ink to be held by a surface tension.

25. The ink jet recorder as claimed in claim 22, wherein an ink inflow port is made in the ink absorption material, said inflow port extends from the top of said ink flow absorption material to the bottom of said ink flow absorption material.

26. The ink jet recorder as claimed in claim 22, wherein said waste ink tank is formed with an opening in an upper area opposed to said cap member and wherein the opening is provided with a blade with which said cap member comes in contact when said cap member is dropped by said capping means drive mechanism.

27. The ink jet recorder as claimed in claim 22, wherein a recess forming a space with a wall face of said waste ink tank or a through hole is made in the outer periphery of the ink absorption material.

28. The ink jet recorder as claimed in claim 26, wherein a cap protective member abutting said cap member is disposed in an upper part of said blade.

29. The ink jet recorder as claimed in claim 28, wherein said cap protective member is impregnated with an ink repellent.

30. A recording head cleaning method comprising the steps of:

sealing nozzle openings in a nozzle plate by a cap member and operating an air pump for supplying ink until a subtank fills with the ink;

detaching said cap member from said nozzle plate to a degree that an ink film can be formed therebetween and forcing the ink to flow out from said nozzle openings for forming an ink film therebetween;

reciprocating a carriage for rubbing said nozzle plate with said cap member via the ink film; and moving a blade disposed in a capping means in an arrangement direction of said nozzle openings for wiping said nozzle plate.

31. A recording head cleaning method comprising the steps of:

sealing nozzle openings in a nozzle plate by a cap member and operating an air pump for supplying ink until a subtank fills with the ink;

detaching said cap member from said nozzle plate and forcing the ink to flow out from said nozzle openings; and moving a blade disposed in a capping means in an arrangement direction of said nozzle openings for wiping said nozzle plate.

32. The recording head cleaning method as claimed in claim 30 or 31, further comprising the step of selecting an interference amount or gap between the blade and the nozzle plate and a relative rate of movement between the nozzle plate and the blade such that said ink film is held between said blade and said nozzle plate in order to execute the wiping.

33. The recording head cleaning method as claimed in claim 32, wherein said interference amount or gap is 1 mm or less from a value allowing the ink film to be formed and the relative rate is 3 mm/second, or less.

34. The recording head cleaning method as claimed in claim 32, wherein the relative rate is 1 mm/second, or less.

* * * * *